US010415848B2

(12) United States Patent
Snider et al.

(10) Patent No.: US 10,415,848 B2
(45) Date of Patent: Sep. 17, 2019

(54) SYSTEMS AND METHODS FOR PIVOTABLE EVAPORATOR COILS

(71) Applicant: Johnson Controls Technology Company, Milwaukee, WI (US)

(72) Inventors: Ryan L. Snider, York, PA (US); Nicholas P. Mislak, Bel Air, MD (US); Kevin R. Stockton, York, PA (US); Kristen Velez-Diaz, York, PA (US); Douglas A. Kester, York, PA (US); Stacy S. Lemkelde, York, PA (US)

(73) Assignee: Johnson Controls Technology Company, Auburn Hills, MI (US)

( * ) Notice: Subject to any disclaimer, the term of this patent is extended or adjusted under 35 U.S.C. 154(b) by 0 days.

(21) Appl. No.: 15/711,911

(22) Filed: Sep. 21, 2017

(65) Prior Publication Data

US 2018/0100671 A1 Apr. 12, 2018

Related U.S. Application Data

(60) Provisional application No. 62/406,302, filed on Oct. 10, 2016.

(51) Int. Cl.

| | |
|---|---|
| ***F24F 13/30*** | (2006.01) |
| ***F24F 11/00*** | (2018.01) |
| ***F24F 13/10*** | (2006.01) |
| ***F24F 11/72*** | (2018.01) |
| *F24F 13/28* | (2006.01) |
| *F24F 3/14* | (2006.01) |
| *F24F 110/10* | (2018.01) |

(Continued)

(52) U.S. Cl.

CPC ..... *F24F 13/30* (2013.01); *F24F 11/0001* (2013.01); *F24F 11/72* (2018.01); *F24F 13/10* (2013.01); *F24F 3/14* (2013.01); *F24F 13/28* (2013.01); *F24F 2110/10* (2018.01); *F24F 2110/20* (2018.01); *F24F 2110/30* (2018.01); *F24F 2110/40* (2018.01); *F25B 2339/02* (2013.01)

(58) Field of Classification Search

CPC ..... F24F 13/30; F24F 11/72; F24F 11/001; F24F 13/10; F24F 2110/20; F24F 2110/30; F24F 2110/40; F24F 2110/10; F24F 3/14; F24F 13/28; F25B 2339/02

See application file for complete search history.

(56) References Cited

U.S. PATENT DOCUMENTS 4,401,149 A * 8/1983 Iijima ..... B60H 1/00835 165/122
4,899,930 A * 2/1990 Kagohata ..... F24F 11/81 236/91 F (Continued)

*Primary Examiner* — Melvin Jones
(74) *Attorney, Agent, or Firm* — Fletcher Yoder, P.C.

(57) ABSTRACT

A heating, ventilation, and air conditioning (HVAC) system includes an enclosure and an evaporator coil disposed within the enclosure. The HVAC system also includes a pivot member coupled between an edge portion of the evaporator coil and the enclosure. The pivot member is configured to enable the evaporator coil to pivot relative to the enclosure to adjust an operating angle of the evaporator coil during operation of the HVAC system. Additionally, the HVAC system includes an actuator configured to enable pivoting of the evaporator coil to a target operating angle based on an operating parameter input.

26 Claims, 10 Drawing Sheets

(51) Int. Cl.

| | |
|---|---|
| *F24F 110/20* | (2018.01) |
| *F24F 110/30* | (2018.01) |
| *F24F 110/40* | (2018.01) |

(56) References Cited

U.S. PATENT DOCUMENTS

| | | | | |
|---|---|---|---|---|
| 5,277,038 | A * | 1/1994 | Carr | B60H 1/00492 165/10 |
| 6,321,556 | B1 | 11/2001 | Tesche et al. | |
| 6,520,850 | B1 * | 2/2003 | Buckman | B60H 1/00678 137/338 |
| 7,540,320 | B1 | 6/2009 | Semmes | |
| 2007/0235161 | A1 | 10/2007 | Barger et al. | |
| 2010/0096108 | A1 | 4/2010 | Castagne | |
| 2011/0308766 | A1 * | 12/2011 | DeAngelis | F24F 3/044 165/59 |
| 2014/0284023 | A1 * | 9/2014 | Sekito | F24F 13/1426 165/59 |
| 2015/0107817 | A1 * | 4/2015 | Douglas | F24F 11/74 165/248 |
| 2015/0354874 | A1 * | 12/2015 | Cur | F24F 1/0007 62/216 |

* cited by examiner

SYSTEMS AND METHODS FOR PIVOTABLE EVAPORATOR COILS

CROSS REFERENCE TO RELATED APPLICATION

This application claims priority from and the benefit of U.S. Provisional Patent Application No. 62/406,302, entitled "EVAPORATOR COIL MOUNTED ON A PIVOT," filed Oct. 10, 2016, which is hereby incorporated by reference.

BACKGROUND

The present disclosure relates generally to heating, ventilating, and air conditioning (HVAC) systems, and more particularly, to systems and methods for pivotable evaporator coils therein.

A wide range of applications exist for HVAC systems. For example, residential, light commercial, commercial, and industrial systems are used to control temperatures and air quality in residences and buildings. Generally, HVAC systems may circulate a fluid, such as a refrigerant, through a closed loop between an evaporator where the fluid absorbs heat and a condenser where the fluid releases heat. The fluid flowing within the closed loop is generally formulated to undergo phase changes within the normal operating temperatures and pressures of the system so that quantities of heat can be exchanged by virtue of the latent heat of vaporization of the fluid.

As such, an HVAC system may control many operating parameters for various components of the HVAC system to provide conditioned air to the residences and the buildings. However, certain components of the HVAC system may be statically mounted in place, thus limiting performance of the HVAC system. Accordingly, it may be desirable to provide HVAC components having more controllable operating parameters to allow for an increase in performance of the HVAC system.

SUMMARY

In one embodiment of the present disclosure, a heating, ventilation, and air conditioning (HVAC) system includes an enclosure and an evaporator coil disposed within the enclosure. The HVAC system also includes a pivot member coupled between an edge portion of the evaporator coil and the enclosure. The pivot member is configured to enable the evaporator coil to pivot relative to the enclosure to adjust an operating angle of the evaporator coil during operation of the HVAC system. Additionally, the HVAC system includes an actuator configured to enable pivoting of the evaporator coil to a target operating angle based on an operating parameter input.

In another embodiment of the present disclosure, a heating, ventilation, and air conditioning (HVAC) system includes an enclosure and an evaporator coil disposed within the enclosure. The HVAC system also includes a pivot member coupled between an edge portion of the evaporator coil and the enclosure. The pivot member is configured to enable the evaporator coil to pivot relative to the enclosure to adjust an operating angle of the evaporator coil during operation of the HVAC system. The HVAC system also includes a controller having a memory and a processor. The controller is configured to determine a target operating angle of the evaporator coil and regulate operation of an actuator to pivot the evaporator coil to have the operating angle within a threshold of the target operating angle.

In a further embodiment of the present disclosure, a method for operating a heating, ventilating, and air conditioning (HVAC) system includes receiving an operating parameter input. The method also includes determining a target operating angle for an evaporator coil disposed in an enclosure of the HVAC system based on the operating parameter input. Moreover, the method includes adjusting an operating angle of the evaporator coil to the target operating angle.

Other features and advantages of the present application will be apparent from the following, more detailed description of the embodiments, taken in conjunction with the accompanying drawings which illustrate, by way of example, the principles of the application.

DRAWINGS

DETAILED DESCRIPTION

The present disclosure is directed to a heating, ventilation, and air conditioning (HVAC) system and systems and methods for a pivotable evaporator coil therein. In general, HVAC systems include multiple components that are designed to condition an interior space. To improve performance of the HVAC systems, various operating parameters of the components are adjusted to more effectively condition the interior space. That is, flow rates, pressures, and temperatures related to the components may be adjusted to increase performance of the HVAC system. Additionally, an evaporator coil of the HVAC system may be mounted within an enclosure of the HVAC system. However, adjusting an operating angle of the evaporator coil relative to the enclosure may increase a cooling and/or a dehumidification capacity (e.g., evaporator capacity) of the evaporator coil. Indeed, in some embodiments, having an evaporator coil with an adjustable operating angle increases a maximum evaporator capacity for the evaporator coil, as compared to stationary evaporator coils. As such, the present disclosure relates to adjusting the operating angle of the evaporator coil within the HVAC system during operation, thus adding an additional degree of freedom to the HVAC system, such that an increased evaporator capacity may be achieved. Additionally, when cooling and/or dehumidification of the HVAC system is not requested, (e.g., when only a fan is turned on and/or when refrigerant is not flowing through the evaporator coil), the evaporator coil may be pivoted out of the way of an air flow through an enclosure having the evaporator coil, thus reducing a pressure drop therethrough.

To facilitate pivoting of the evaporator coil, the evaporator coil may be mounted on one or more pivoting members. For example, the evaporator coil may be coupled to the enclosure via a pivot shaft coupled to an edge portion of the evaporator coil. The pivot shaft may include end portions or pins received in corresponding recesses or openings through lateral walls of the enclosure, such that the pivot shaft may rotate along a circumferential axis extending through the pivot shaft. To direct an air flow through the evaporator coil, a sealing assembly may be included on an opposite edge of the evaporator coil. The sealing assembly may include a flexible or rigid sheet member to reduce an area between the evaporator coil and the enclosure through which the air flow may bypass the evaporator coil. Further, to actuate pivoting of the evaporator coil, an actuator may be included in the HVAC system to move the evaporator coil and/or the sealing member to a target operating angle, as discussed in more detail below.

Figure 1:
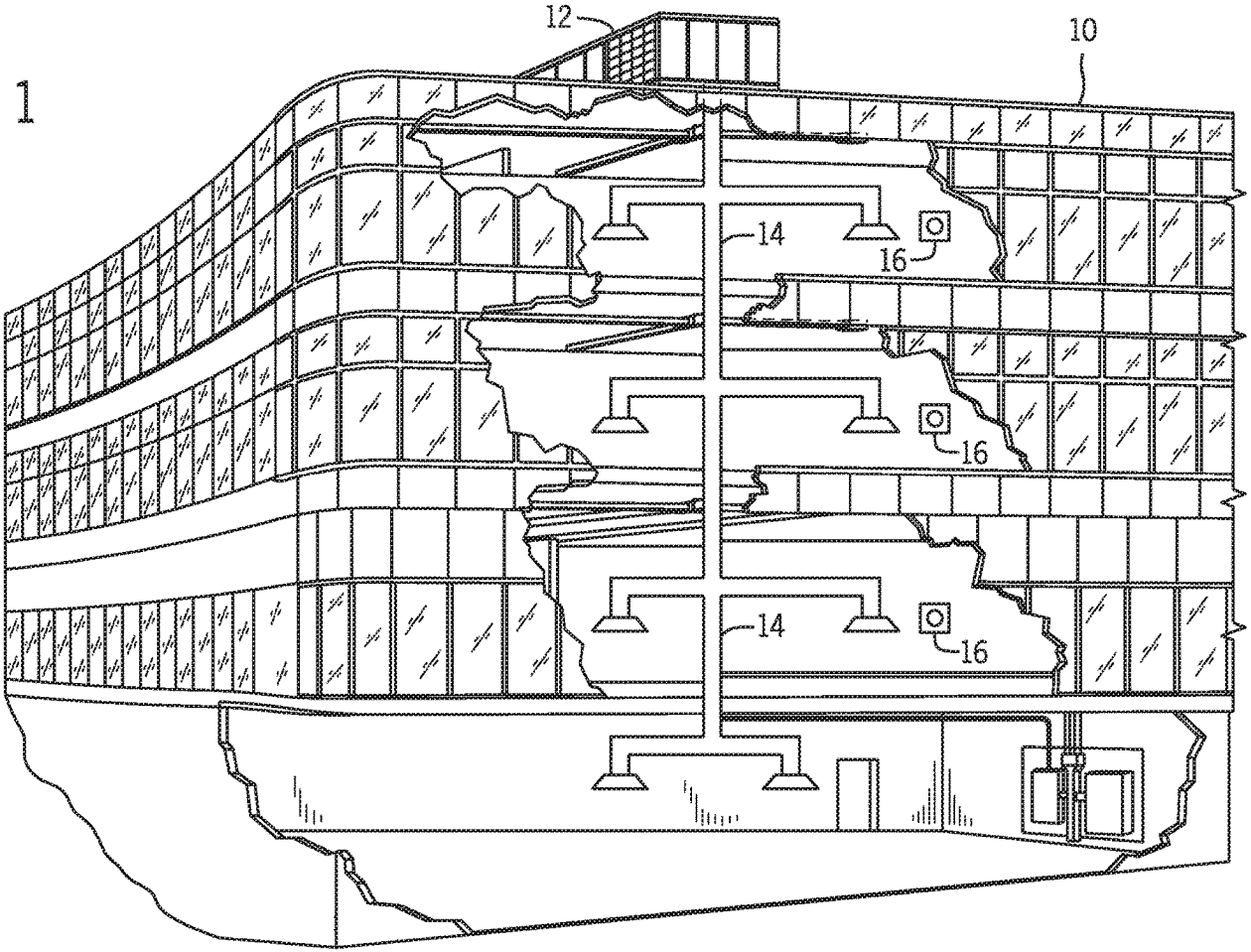
FIG. 1 is an illustration of an embodiment of a commercial or industrial HVAC system, in accordance with the present techniques.

Turning now to the drawings, FIG. 1 illustrates a heating, ventilating, and air conditioning (HVAC) system for building environmental management that may employ one or more HVAC units. In the illustrated embodiment, a building 10 is air conditioned by a system that includes an HVAC unit 12. The building 10 may be a commercial structure or a residential structure. As shown, the HVAC unit 12 is disposed on the roof of the building 10; however, the HVAC unit 12 may be located in other equipment rooms or areas adjacent the building 10. The HVAC unit 12 may be a single package unit containing other equipment, such as a blower, integrated air handler, and/or auxiliary heating unit. In other embodiments, the HVAC unit 12 may be part of a split HVAC system, such as the system shown in FIG. 3, which includes an outdoor HVAC unit 58 and an indoor HVAC unit 56.

The HVAC unit 12 is an air cooled device that implements a refrigeration cycle to provide conditioned air to the building 10. Specifically, the HVAC unit 12 may include one or more heat exchangers across which an air flow is passed to condition the air flow before the air flow is supplied to the building. In the illustrated embodiment, the HVAC unit 12 is a rooftop unit (RTU) that conditions a supply air stream, such as environmental air and/or a return air flow from the building 10. After the HVAC unit 12 conditions the air, the air is supplied to the building 10 via ductwork 14 extending throughout the building 10 from the HVAC unit 12. For example, the ductwork 14 may extend to various individual floors or other sections of the building 10. In certain embodiments, the HVAC unit 12 may be a heat pump that provides both heating and cooling to the building with one refrigeration circuit configured to operate in different modes. In other embodiments, the HVAC unit 12 may include one or more refrigeration circuits for cooling an air stream and a furnace for heating the air stream.

A control device 16, one type of which may be a thermostat, may be used to designate the temperature of the conditioned air. The control device 16 also may be used to control the flow of air through the ductwork 14. For example, the control device 16 may be used to regulate operation of one or more components of the HVAC unit 12 or other components, such as dampers and fans, within the building 10 that may control flow of air through and/or from the ductwork 14. In some embodiments, other devices may be included in the system, such as pressure and/or temperature transducers or switches that sense the temperatures and pressures of the supply air, return air, and so forth. Moreover, the control device 16 may include computer systems that are integrated with or separate from other building control or monitoring systems, and even systems that are remote from the building 10.

Figure 2:
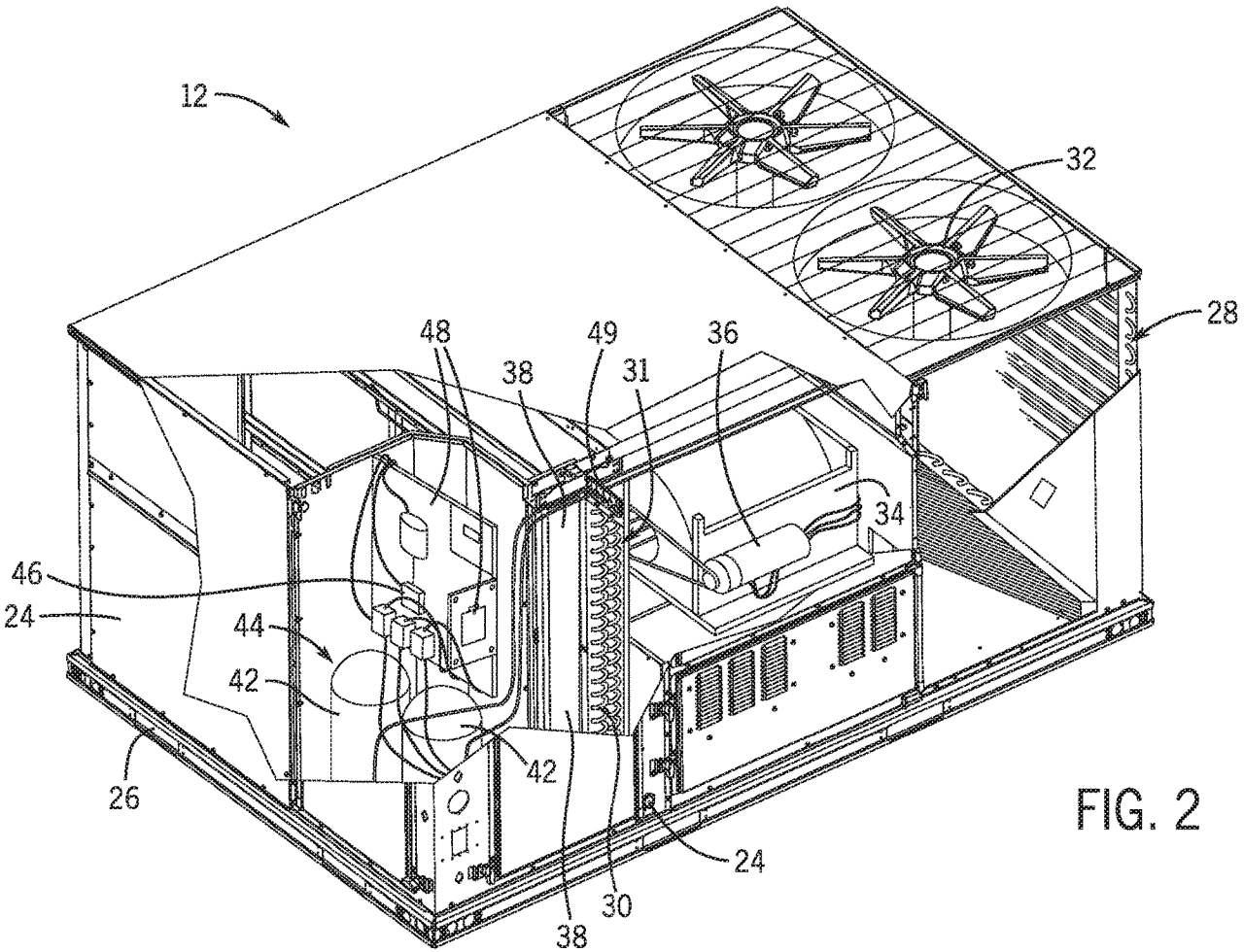
FIG. 2 is an illustration of an embodiment of a packaged unit of the HVAC system, in accordance with the present techniques.

FIG. 2 is a perspective view of an embodiment of the HVAC unit 12. In the illustrated embodiment, the HVAC unit 12 is a single package unit that may include one or more independent refrigeration circuits and components that are tested, charged, wired, piped, and ready for installation. The HVAC unit 12 may provide a variety of heating and/or cooling functions, such as cooling only, heating only, cooling with electric heat, cooling with dehumidification, cooling with gas heat, or cooling with a heat pump. As described above, the HVAC unit 12 may directly cool and/or heat an air stream provided to the building 10 to condition a space in the building 10.

As shown in the illustrated embodiment of FIG. 2, a cabinet 24 encloses the HVAC unit 12 and provides structural support and protection to the internal components from environmental and other contaminants. In some embodiments, the cabinet 24 may be constructed of galvanized steel and insulated with aluminum foil faced insulation. Rails 26 may be joined to the bottom perimeter of the cabinet 24 and provide a foundation for the HVAC unit 12. In certain embodiments, the rails 26 may provide access for a forklift and/or overhead rigging to facilitate installation and/or removal of the HVAC unit 12. In some embodiments, the rails 26 may fit into "curbs" on the roof to enable the HVAC unit 12 to provide air to the ductwork 14 from the bottom of the HVAC unit 12 while blocking elements such as rain from leaking into the building 10.

The HVAC unit 12 includes heat exchangers 28 and 30 in fluid communication with one or more refrigeration circuits. Tubes within the heat exchangers 28 and 30 may circulate refrigerant (for example, R-410A, steam, or water) through the heat exchangers 28 and 30. The tubes may be of various types, such as multichannel tubes, conventional copper or aluminum tubing, and so forth. Together, the heat exchangers 28 and 30 may implement a thermal cycle in which the refrigerant undergoes phase changes and/or temperature changes as it flows through the heat exchangers 28 and 30 to produce heated and/or cooled air. For example, the heat exchanger 28 may function as a condenser where heat is released from the refrigerant to ambient air, and the heat exchanger 30 may function as an evaporator where the refrigerant absorbs heat to cool an air stream. In other embodiments, the HVAC unit 12 may operate in a heat pump mode where the roles of the heat exchangers 28 and 30 may be reversed. That is, the heat exchanger 28 may function as an evaporator and the heat exchanger 30 may function as a condenser. In further embodiments, the HVAC unit 12 may include a furnace for heating the air stream that is supplied to the building 10. While the illustrated embodiment of FIG. 2 shows the HVAC unit 12 having two of the heat exchangers 28 and 30, in other embodiments, the HVAC unit 12 may include one heat exchanger or more than two heat exchangers.

The heat exchanger 30 is located within a compartment 31 that separates the heat exchanger 30 from the heat exchanger 28. Fans 32 draw air from the environment through the heat exchanger 28. Air may be heated and/or cooled as the air flows through the heat exchanger 28 before being released back to the environment surrounding the rooftop unit 12. A blower assembly 34, powered by a motor 36, draws air through the heat exchanger 30 to heat or cool the air. The heated or cooled air may be directed to the building 10 by the ductwork 14, which may be connected to the HVAC unit 12. Before flowing through the heat exchanger 30, the conditioned air flows through one or more filters 38 that may remove particulates and contaminants from the air. In certain embodiments, the filters 38 may be disposed on the air intake side of the heat exchanger 30 to prevent contaminants from contacting the heat exchanger 30.

The HVAC unit 12 also may include other equipment for implementing the thermal cycle. Compressors 42 increase the pressure and temperature of the refrigerant before the refrigerant enters the heat exchanger 28. The compressors 42 may be any suitable type of compressors, such as scroll compressors, rotary compressors, screw compressors, or reciprocating compressors. In some embodiments, the compressors 42 may include a pair of hermetic direct drive compressors arranged in a dual stage configuration 44. However, in other embodiments, any number of the compressors 42 may be provided to achieve various stages of heating and/or cooling. As may be appreciated, additional equipment and devices may be included in the HVAC unit 12, such as a solid-core filter drier, a drain pan, a disconnect switch, an economizer, pressure switches, phase monitors, and humidity sensors, among other things.

The HVAC unit 12 may receive power through a terminal block 46. For example, a high voltage power source may be connected to the terminal block 46 to power the equipment. The operation of the HVAC unit 12 may be governed or regulated by a control board 48. The control board 48 may include control circuitry connected to a thermostat, sensors, and alarms (one or more being referred to herein separately or collectively as the control device 16). The control circuitry may be configured to control operation of the equipment, provide alarms, and monitor safety switches. Wiring 49 may connect the control board 48 and the terminal block 46 to the equipment of the HVAC unit 12.

Figure 3:
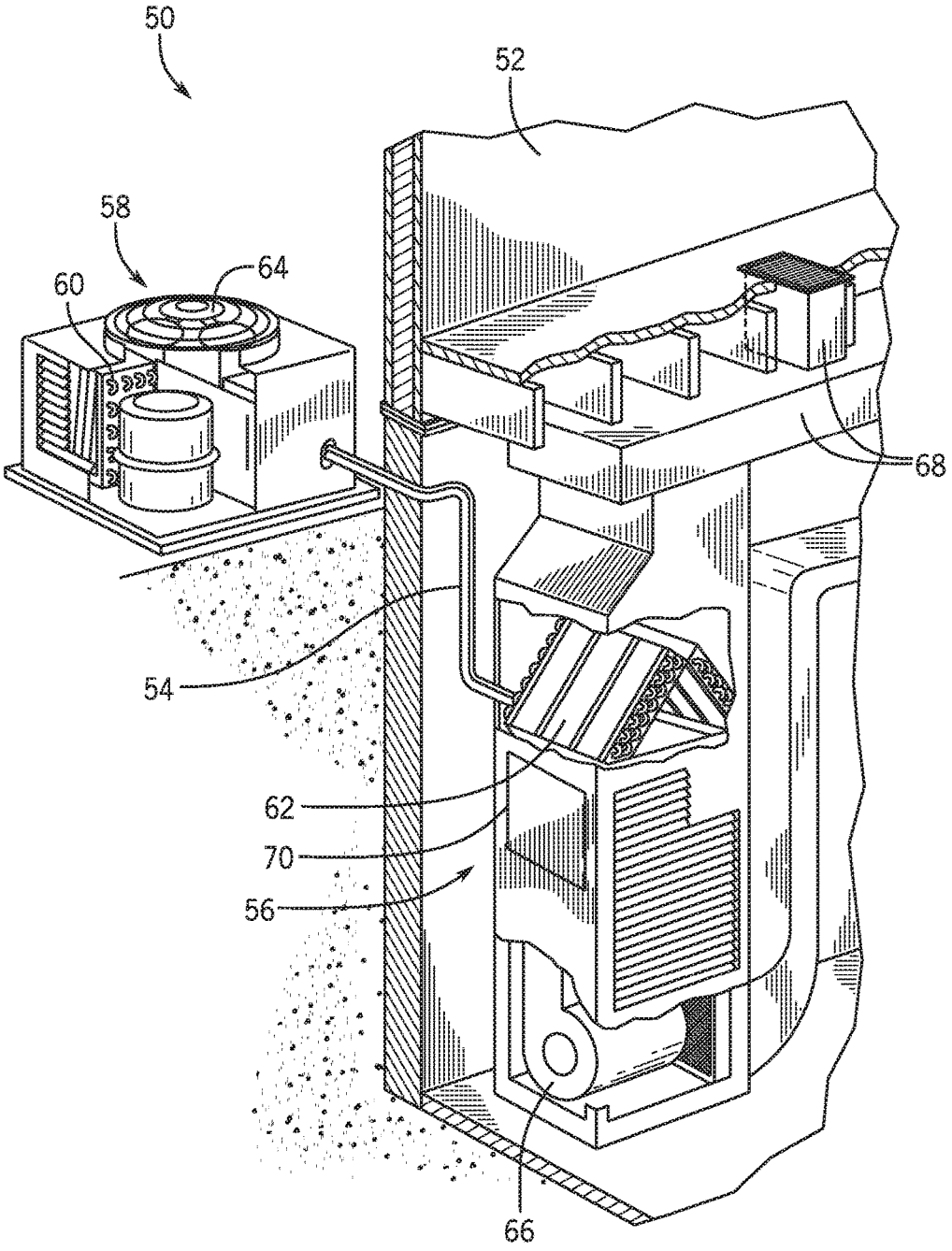
FIG. 3 is an illustration of an embodiment of a split system of the HVAC system, in accordance with the present techniques.

FIG. 3 illustrates a residential heating and cooling system 50, also in accordance with present techniques. The residential heating and cooling system 50 may provide heated and cooled air to a residential structure, as well as provide outside air for ventilation and provide improved indoor air quality (IAQ) through devices such as ultraviolet lights and air filters. In the illustrated embodiment, the residential heating and cooling system 50 is a split HVAC system. In general, a residence 52 conditioned by a split HVAC system may include refrigerant conduits 54 that operatively couple the indoor unit 56 to the outdoor unit 58. The indoor unit 56 may be positioned in a utility room, an attic, a basement, and so forth. The outdoor unit 58 is typically situated adjacent to a side of residence 52 and is covered by a shroud to protect the system components and to prevent leaves and other debris or contaminants from entering the unit. The refrigerant conduits 54 transfer refrigerant between the indoor unit 56 and the outdoor unit 58, typically transferring primarily liquid refrigerant in one direction and primarily vaporized refrigerant in an opposite direction.

When the system shown in FIG. 3 is operating as an air conditioner, a heat exchanger 60 in the outdoor unit 58 serves as a condenser for re-condensing vaporized refrigerant flowing from the indoor unit 56 to the outdoor unit 58 via one of the refrigerant conduits 54. In these applications, a heat exchanger 62 of the indoor unit functions as an evaporator. Specifically, the heat exchanger 62 receives liquid refrigerant (which may be expanded by an expansion device, not shown) and evaporates the refrigerant before returning it to the outdoor unit 58.

The outdoor unit 58 draws environmental air through the heat exchanger 60 using a fan 64 and expels the air above the outdoor unit 58. When operating as an air conditioner, the air is heated by the heat exchanger 60 within the outdoor unit 58 and exits the unit at a temperature higher than it entered. The indoor unit 56 includes a blower or fan 66 that directs air through or across the indoor heat exchanger 62, where the air is cooled when the system is operating in air conditioning mode. Thereafter, the air is passed through ductwork 68 that directs the air to the residence 52. The overall system operates to maintain a desired temperature as set by a system controller. When the temperature sensed inside the residence 52 is higher than the set point on the thermostat (plus a small amount), the residential heating and cooling system 50 may become operative to refrigerate additional air for circulation through the residence 52. When the temperature reaches the set point (minus a small amount), the residential heating and cooling system 50 may stop the refrigeration cycle temporarily.

The residential heating and cooling system 50 may also operate as a heat pump. When operating as a heat pump, the roles of heat exchangers 60 and 62 are reversed. That is, the heat exchanger 60 of the outdoor unit 58 will serve as an evaporator to evaporate refrigerant and thereby cool air entering the outdoor unit 58 as the air passes over outdoor the heat exchanger 60. The indoor heat exchanger 62 will receive a stream of air blown over it and will heat the air by condensing the refrigerant.

In some embodiments, the indoor unit 56 may include a furnace system 70. For example, the indoor unit 56 may include the furnace system 70 when the residential heating and cooling system 50 is not configured to operate as a heat pump. The furnace system 70 may include a burner assembly and heat exchanger, among other components, inside the indoor unit 56. Fuel is provided to the burner assembly of the furnace 70 where it is mixed with air and combusted to form combustion products. The combustion products may pass through tubes or piping in a heat exchanger (that is, separate from heat exchanger 62), such that air directed by the blower 66 passes over the tubes or pipes and extracts heat from the combustion products. The heated air may then be routed from the furnace system 70 to the ductwork 68 for heating the residence 52.

Figure 4:
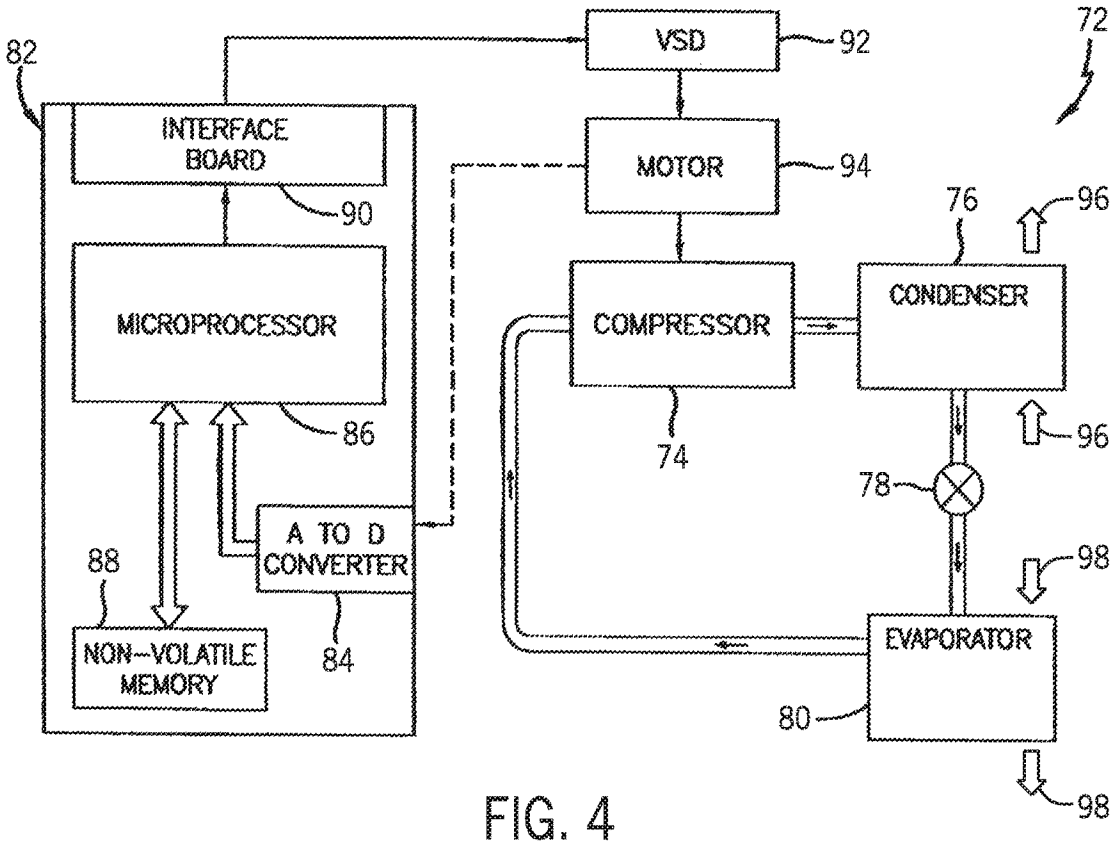
FIG. 4 is a schematic diagram of an embodiment of a refrigeration system of the HVAC system, in accordance with the present techniques.

FIG. 4 is an embodiment of a vapor compression system 72 that can be used in any of the systems described above. The vapor compression system 72 may circulate a refrigerant through a circuit starting with a compressor 74. The circuit may also include a condenser 76, an expansion valve(s) or device(s) 78, and an evaporator 80. The vapor compression system 72 may further include a control panel 82 that has an analog to digital (A/D) converter 84, a microprocessor 86, a non-volatile memory 88, and/or an interface board 90. The control panel 82 and its components may function to regulate operation of the vapor compression system 72 based on feedback from an operator, from sensors of the vapor compression system 72 that detect operating conditions, and so forth.

In some embodiments, the vapor compression system 72 may use one or more of a variable speed drive (VSDs) 92, a motor 94, the compressor 74, the condenser 76, the expansion valve or device 78, and/or the evaporator 80. The motor 94 may drive the compressor 74 and may be powered by the variable speed drive (VSD) 92. The VSD 92 receives alternating current (AC) power having a particular fixed line voltage and fixed line frequency from an AC power source, and provides power having a variable voltage and frequency to the motor 94. In other embodiments, the motor 94 may be powered directly from an AC or direct current (DC) power source. The motor 94 may include any type of electric motor that can be powered by a VSD or directly from an AC or DC power source, such as a switched reluctance motor, an induction motor, an electronically commutated permanent magnet motor, or another suitable motor.

The compressor 74 compresses a refrigerant vapor and delivers the vapor to the condenser 76 through a discharge passage. In some embodiments, the compressor 74 may be a centrifugal compressor. The refrigerant vapor delivered by the compressor 74 to the condenser 76 may transfer heat to a fluid passing across the condenser 76, such as ambient or environmental air 96. The refrigerant vapor may condense to a refrigerant liquid in the condenser 76 as a result of thermal heat transfer with the environmental air 96. The liquid refrigerant from the condenser 76 may flow through the expansion device 78 to the evaporator 80.

The liquid refrigerant delivered to the evaporator 80 may absorb heat from another air stream, such as a supply air stream 98 provided to the building 10 or the residence 52. For example, the supply air stream 98 may include ambient or environmental air, return air from a building, or a combination of the two. The liquid refrigerant in the evaporator 80 may undergo a phase change from the liquid refrigerant to a refrigerant vapor. In this manner, the evaporator 38 may reduce the temperature of the supply air stream 98 via thermal heat transfer with the refrigerant. Thereafter, the vapor refrigerant exits the evaporator 80 and returns to the compressor 74 by a suction line to complete the cycle.

In some embodiments, the vapor compression system 72 may further include a reheat coil in addition to the evaporator 80. For example, the reheat coil may be positioned downstream of the evaporator relative to the supply air stream 98 and may reheat the supply air stream 98 when the supply air stream 98 is overcooled to remove humidity from the supply air stream 98 before the supply air stream 98 is directed to the building 10 or the residence 52.

It should be appreciated that any of the features described herein may be incorporated with the HVAC unit 12, the residential heating and cooling system 50, or other HVAC systems. Additionally, while the features disclosed herein are described in the context of embodiments that directly heat and cool a supply air stream provided to a building or other load, embodiments of the present disclosure may be applicable to other HVAC systems as well. For example, the features described herein may be applied to mechanical cooling systems, free cooling systems, chiller systems, or other heat pump or refrigeration applications.

As discussed above, the present techniques are directed to a pivotable evaporator coil of an HVAC system that may pivot to various operating angles to improve the cooling and/or the dehumidification capacity of the evaporator coil (e.g., evaporator capacity). For example, the heat exchangers 60, 62 discussed above may be mounted on one or more pivot members to enable rotation to various operating angles. Indeed, any suitable heat exchanger, such as an evaporator coil, a condenser coil, or other heat exchangers, may benefit from the techniques described herein. The pivot members may include a pivot shaft or one or more hinges to enable rotation of the evaporator coil relative to an enclosure disposed around the evaporator coil. Additionally, to direct air flows passing through the enclosure into contact with the evaporator coil, a sealing assembly may be coupled between the evaporator coil and the enclosure. That is, the sealing assembly may reduce, block, or eliminate air flows from bypassing the evaporator coil, thus increasing the evaporator capacity, the maximum achievable evaporator capacity, and/or an efficiency of the evaporator coil for conditioning the air flowing through the enclosure. As discussed in more detail below, each of these components of the HVAC system may be customized or adapted in various ways to enable pivoting of the evaporator coil to various operating angles.

Figure 5:
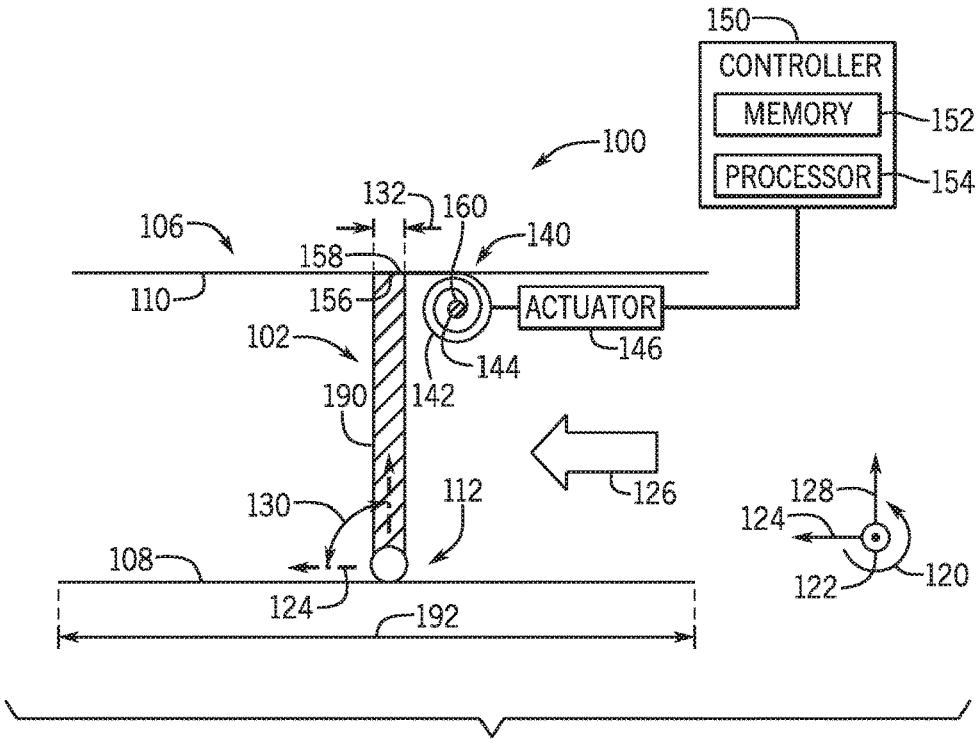
FIG. 5 is a schematic diagram of an embodiment of a pivotable evaporator coil of the HVAC system, in accordance with the present techniques.

FIG. 5 is a schematic diagram illustrating an embodiment of an HVAC system 100 having an evaporator coil 102 (e.g., pivotable evaporator coil). In some embodiments, the HVAC system 100 is part of the HVAC unit 12 discussed above, the residential heating and cooling system 50 discussed above, and/or other HVAC systems. Moreover, the HVAC system 100 may perform all or a combination of heating, ventilation, and/or air conditioning functions. The evaporator coil 102 is disposed within an enclosure 106 having a lower wall 108 and an upper wall 110. As shown, the evaporator coil 102 is also rigidly (e.g., statically) coupled to a pivot shaft 112 that is rotably mounted within the enclosure 106. Thus, the evaporator coil 102 may rotate relative to the enclosure 106 based on rotation of the pivot shaft 112. As such, by pivoting along a circumferential axis 120 around a longitudinal axis 122 (e.g., extending into the page), the evaporator coil 102 may move between various operating angles relative to a horizontal axis 124 of the enclosure 106.

As shown, an air flow 126 flows through the enclosure 106. The air flow 126 may be return air and/or outside air that passes through the evaporator coil 102 to be cooled and/or dehumidified before being supplied to a conditioned space. In some embodiments, the air flow 126 may generally travel within the enclosure 106 along a direction that is parallel or substantially similar (e.g., within 5%) to the horizontal axis 124. Thus, relative to the horizontal axis 124 extending along the enclosure 106, an operating angle 130 of the evaporator coil 102 may be approximately 90 degrees, as shown. With the evaporator coil 102 in a vertical position (e.g., having the operating angle 130 of 90 degrees, having the operating angle 130 within a threshold range of approximately 90 degrees), the air flow 126 may generally contact or impinge the evaporator coil 102 in a perpendicular, transverse, or crosswise manner. As such, the air flow 126 may generally pass through a horizontal width 132 of the evaporator. As will be described with reference to FIG. 6 below, when the evaporator coil 102 is disposed at various operating angles relative to the enclosure 106, the air flow 126 may contact the evaporator coil 102 at corresponding angles. Additionally, over various operating angles 130, the air flow 126 may flow over coils of the evaporator coil 102 for corresponding horizontal widths and/or at corresponding velocities. Accordingly, pivoting of the evaporator coil 102 during operation provides an additional degree of freedom to the HVAC system 100, such that the operating angle 130 of the evaporator coil 102 is adjustable to increase the evaporator capacity of the evaporator coil 102 relative to evaporator coils without adjustable operating angles.

Moreover, the HVAC system 100 includes a sealing assembly 140 having a rolling sheet member 142 disposed at least partially around a rolling shaft 144. The rolling shaft 144 may be drivable by an actuator 146. Additionally, a controller 150 having a memory 152 and a processor 154 may provide control signals to the actuator 146 to control the actuator 146, and by extension, to control the rolling shaft 144 and the rolling sheet member 142. In some embodiments, a first end 156 of the rolling sheet member 142 is coupled to an upper edge 158 of the evaporator coil 102, and a second end 160 of the rolling sheet member 142 is coupled to the rolling shaft 144. In some embodiments, the controller 150 instructs the actuator 146 to rotate the rolling shaft 144 along the circumferential axis 120 (e.g., in a counter-clockwise direction). Then, a portion of the rolling sheet member 142 may unspool or extend from the rolling shaft 144, thus exposing a greater length of the rolling sheet member 142 between the rolling shaft 144 and the evaporator coil 102. In some embodiments, the controller 150 may alternatively instruct the actuator 146 to rotate the rolling shaft 144 along a direction opposite of the circumferential axis 120 (e.g., in a clockwise direction) to spool or retract a corresponding length of the rolling sheet member 142 around the rolling shaft 144.

Because the rolling sheet member 142 is also coupled to the upper edge 158 of the evaporator coil 102, when the rolling sheet member 142 is unspooled, the evaporator coil 102 may pivot via the pivot shaft 112 around the circumferential axis 120. More particularly, the air flow 126 may provide a horizontal force on the evaporator coil 102, while a vertical gravitational force also pushes downward on the evaporator coil 102. Accordingly, to transition from a vertical position having an operating angle 130 of approximately 90 degrees, the rolling sheet member 142 may be adjusted, such that the air flow 126 and the gravitational force naturally rotate the evaporator coil 102 to a desired operating angle. Additionally or alternatively, in some embodiments, the pivot shaft 112 may be powered and/or motorized to pivot the evaporator coil 102. Moreover, pivoting of the evaporator coil 102 will be better understood with reference to the evaporator coil 102 at a tilted operating angle, as discussed below.

Figure 6:
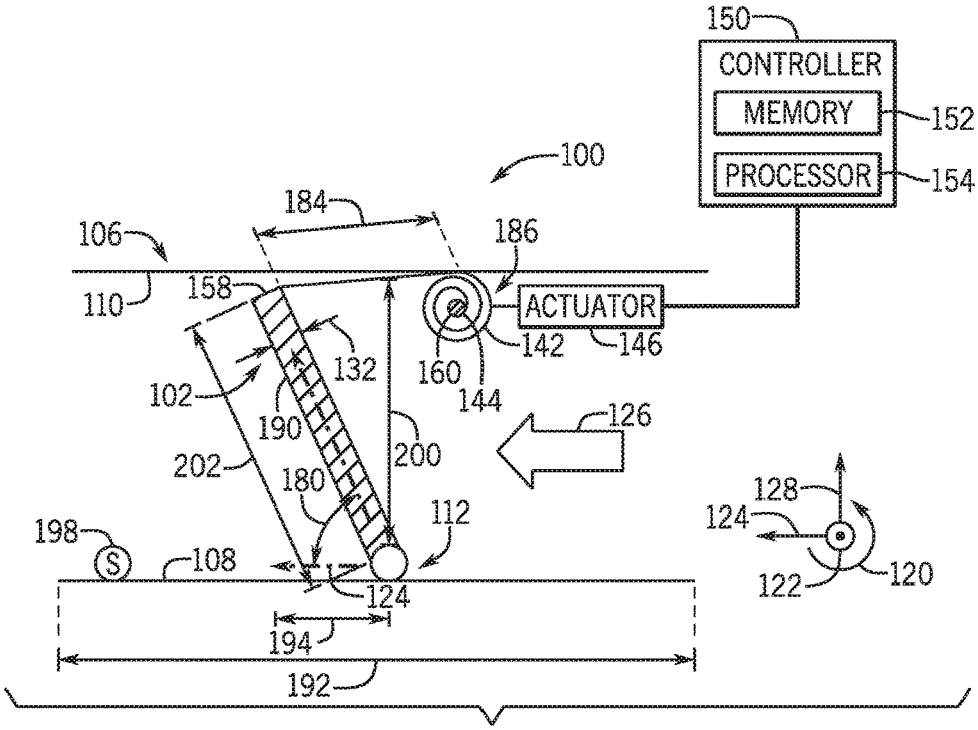
FIG. 6 is a schematic diagram of an embodiment of the evaporator coil of FIG. 5 illustrating a tilted operating angle, in accordance with the present techniques.

For example, FIG. 6 is a schematic diagram of an embodiment of the evaporator coil 102 having a tilted operating angle 180. In some embodiments of the evaporator coil 102, a tilted operating angle corresponds to the operating angle 180 of the evaporator coil 102 being between 0 degrees and 90 degrees or between 90 degrees and 180 degrees relative to the horizontal axis 124. As such, the air flow 126 through the enclosure 106 may generally change direction upon entering or shortly after entering the evaporator coil 102 to flow through the horizontal width 132 of the evaporator coil 102, thus resulting in different streamlines of the air flow 126 therethrough. The streamlines of the air flow 126 through the evaporator coil 102 at the tilted operating angle 180 may be different than streamlines of the air flow 126 through the horizontal width 132 of the evaporator coil at the vertical operating angle 130 (FIG. 5), thus resulting in a different evaporator capacity. Thus, the operating angle of the evaporator coil 102 may be adjusted during operation to change the streamlines of the air flow 126 through the evaporator coil 102 to change the evaporator capacity (e.g., increase the maximum, achievable evaporator capacity).

To move the evaporator coil 102 from the vertical operating angle 130 (FIG. 5) to the tilted operating angle 180, the controller 150 may instruct the actuator 146 to rotate the rolling shaft 144. In the depicted embodiment, the rolling shaft 144 may generally rotate counter-clockwise relative to the longitudinal axis 122 (e.g., along the circumferential axis 120) to unspool the rolling sheet member 142 and may generally rotate clockwise relative to the longitudinal axis 122 (e.g., opposite of the circumferential axis 120) to spool the rolling sheet member 142. Thus, by actuating the rolling shaft 144 to unspool the rolling sheet member 142, the controller 150 may increase an unrolled length 184 of the rolling sheet member 142 that extends between the top edge 158 of the evaporator coil 102 and a remaining rolled portion 186 of the rolling sheet member 142.

Thus, upon instruction by the controller 150, the rolling sheet member 142 may generally tether the evaporator coil 102 to a desired operating angle. That is, while gravity pushes downward on the evaporator coil 102 to encourage the evaporator coil 102 to pivot closer to a horizontal position, the rolling sheet member 142 provides a force (e.g., horizontal and/or vertical force) to the evaporator coil 102 to pull on the evaporator coil 102, thus keeping the evaporator coil 102 in place. In this manner, when the unrolled length 184 of the rolling sheet member 142 is extended (e.g., lengthened), the evaporator coil 102 may lean further along the circumferential axis 120 (e.g., to the left side of the page), thus decreasing the operating angle 180 relative to the horizontal axis 124. Additionally, when the unrolled length 184 of the rolling sheet member 142 is contracted (e.g., shortened), the evaporator coil may lean further opposite of the circumferential axis 120 (e.g., to the right side of the page), thus increasing the operating angle 180 relative to the horizontal axis 124. By adjusting the unrolled length 184 of the rolling sheet member 142, the controller 150 may move the evaporator coil 102 between a range of operating angles 180. Indeed, the operating angle 180 of the evaporator coil 102 may be adjusted during operation of the HVAC system 100 as an operating parameter of the HVAC system 100 to increase the evaporator capacity of the evaporator coil 102.

The operating angle 180 of the evaporator coil 102 may be adjusted between a wide range of angles relative to the horizontal axis 124. For example, the evaporator coil 102 may be pivoted along the circumferential axis 120 until a left lateral side 190 of the evaporator coil 102 is in contact with the lower wall 108 of the enclosure 106. As such, a length 192 of the enclosure 106 may be adapted (e.g., formed, built, retroactively fitted, etc.) so that horizontal space is provided in the enclosure 106 for an effective length 194 evaporator coil 102 (e.g., horizontal component of a vector defined by the evaporator coil 102) to extend therein. Moreover, if the HVAC system 100 rotates the evaporator coil 102 to the horizontal operating angle of 0 degrees, as discussed below with reference to FIG. 7, the enclosure 106 may include enough space to receive the corresponding effective length 194 of the evaporator coil 102.

In operation of the HVAC system 100, the controller 150 may determine a target operating angle for the evaporator coil 102 based on various operating parameters (e.g., operating parameter inputs) of the HVAC system 100. For example, the controller 150 may receive input from and transmit control signals to temperature sensors, pressure sensors, flow sensors, electricity meters, voltage sensors, contact sensors, thermostats, humidistats, user interfaces, and the like to operate the HVAC system 100 to condition the interior space. Additionally, the HVAC system 100 may adjust the operating angle 180 as another operating parameter of the HVAC system 100 to more effectively and/or efficiently condition the interior space. As such, optimizing or changing the operating angle 180 of the evaporator coil 102 may provide an additional degree of freedom to calculations performed by the HVAC system 100, thus providing more operating conditions and/or solutions to models (e.g., transfer functions) that the HVAC system 100 may use to condition the interior space. For example, in some embodiments, the controller 150 may pivot the evaporator coil 102 to a position that results in a maximum evaporator capacity. Additionally, in certain embodiments, the controller 150 may pivot the evaporator coil 102 to another angle that does not correspond to the maximum evaporator capacity (e.g., if reduced cooling for the conditioned space is requested). In this manner, adjusting the operating angle of the evaporator coil 102 allows for increasing or decreasing the evaporator capacity for improved capacity control based on the operating parameters of the HVAC system 100.

By way of an example, the controller 150 may receive input indicative of a request to decrease a temperature of the conditioned space. As such, the controller 150 determines that the evaporator coil 102 should decrease a temperature of the air flow 126 passing through the evaporator coil 102. Thus, to increase the evaporator capacity of the evaporator coil 102, the controller 150 may determine a target operating angle, such as 75 degrees relative to the horizontal axis 124. Next, the controller 150 may instruct the actuator 146 to rotate the rolling shaft 144 to unspool the unrolled length 184 of the rolling sheet member 142. In response to the increased slack (e.g., increased unrolled length 184) in the rolling sheet member 142, the evaporator coil 102 may pivot along the pivot shaft 112 until the unrolled length 184 of the rolling sheet member 142 draws taut. Then, the evaporator coil 102 may be at the operating angle 180 that corresponds to the target operating angle. Moreover, in some embodiments, the evaporator coil 102 may be considered to be at the target operating angle if the operating angle 180 of the evaporator coil 102 is within a threshold range from the target operating angle. In some embodiments, the threshold range may be set by default, by a user, or the like. In addition, the threshold range may be any suitable number of degrees relative to the target operating angle, such as 1 degree, 2, degrees, 3 degrees, 4 degrees, 5 degrees, or the like. Moreover, the threshold range may be a proportional value relative to the target operating angle, such as 1 percent, 2 percent, 3, percent, 4 percent, 5 percent, or the like relative to the target operating angle. Additionally, other mechanisms may be included in the HVAC system 100 to enable the evaporator coil 102 to pivot to various operating angles, such as an actuated pivot shaft, an actuated track assembly, or other suitable components, some of which are discussed below.

It is to be understood that the HVAC system 100 may determine that the operating angle of the evaporator coil 102 corresponds to the target operating angle set by the controller 150 via different control mechanisms. Additionally, the control mechanisms may be user-customizable, such that a user of the HVAC system 100 may select, order, customize, or upgrade the HVAC system 100 to include the desired control mechanisms. For example, the controller 150 may monitor the operating angle 180 of the evaporator coil 102 based on a log of control signals that the controller 150 sent to the actuator 146 and then stored in the memory 152. That is, the controller 150 may keep track of a current position of the actuator 146 and which steps the actuator 146 has performed since a last startup of the HVAC system 100. Additionally or alternatively, the HVAC system 100 may monitor motion of the rolling shaft 144 to calculate the unrolled length 184 of the rolling sheet member 142. Thus, by monitoring the rolling shaft 144 and/or the actuator 146 that actuates the rolling shaft 144, the controller 150 may determine the unrolled length 184. Based on the unrolled length 184, the controller 150 may employ trigonometric calculations to determine the current operating angle 180 of the evaporator coil 102. That is, a triangle having a first side represented by the evaporator coil 102, a second side represented by the unrolled length 184, and a third side represented by a vertical axis 128 extending vertically from the pivot shaft 112 to the unrolled length may be used by the controller 150 to determine an angle that is complementary to the operating angle of the evaporator coil 102 relative to the horizontal axis 124. Other suitable triangles or determinations will be apparent to those skilled in the art, such as determinations made from a triangle defined between the evaporator coil 102, the unrolled length 184, and the lower wall 108 of the enclosure 106. Additionally, one or all of the determinations discussed herein may be performed in any suitable combination and/or order by any suitable device.

In certain embodiments, the controller 150 may monitor the operating angle of the evaporator coil 102 based on sensor feedback. In such embodiments, one or more sensors, such as a sensor 198, may be disposed within the enclosure 106. For example, the sensor 198 may include a magnetic switch, a Hall sensor, a contact sensor, a visual sensor, an optical sensor, or any other suitable sensor or sensor array. Based on input from the sensor 198, the controller 150 may be able to determine the current operating angle 180 of the evaporator coil 102. For example, if the sensor 198 is a visual sensor, the controller 150 may receive signals therefrom indicative of a front-on view of the evaporator coil 102 (e.g., within the plane defined by the longitudinal axis 122 and the vertical axis 128. From the signals, the controller 150 may be able to determine an effective height 200 of the evaporator coil 102 (e.g., vertical component of a vector defined by the evaporator coil 102), and then using trigonometric calculations, the controller 150 may determine the operating angle 180 of the evaporator coil 102 relative to the horizontal axis 124. For example, if the controller 150 receives signals indicating that the evaporator coil 102 includes an effective height 200 of one meter, and the controller 150 knows that an actual length 202 of the evaporator coil 102 is two meters, the controller 150 may determine that the operating angle 180 is 60 degrees. Other sensors may be used to enable the controller 150 to sense the current operating angle of the evaporator coil by other suitable determinations, such as by transmitting signals indicative of a position of the upper edge 158 of the evaporator coil 102, or transmitting signals indicative of when a portion of the evaporator coil 102 contacts the sensor 198 or any other suitable sensors.

Based on a sensed position of the evaporator coil 102, the controller 150 may adjust the operating angle 180 of the evaporator coil 102 with greater precision and accuracy as compared to HVAC systems without sensor feedback. Moreover, as discussed above, the controller 150 may adjust the operating angle 180 to be within a threshold range of the target operating angle. The threshold may be defined as any suitable reference window from the target operating angle, such as one degree, five degrees, 10 degrees, or another suitable number of degrees from the target operating angle.

Figure 7:
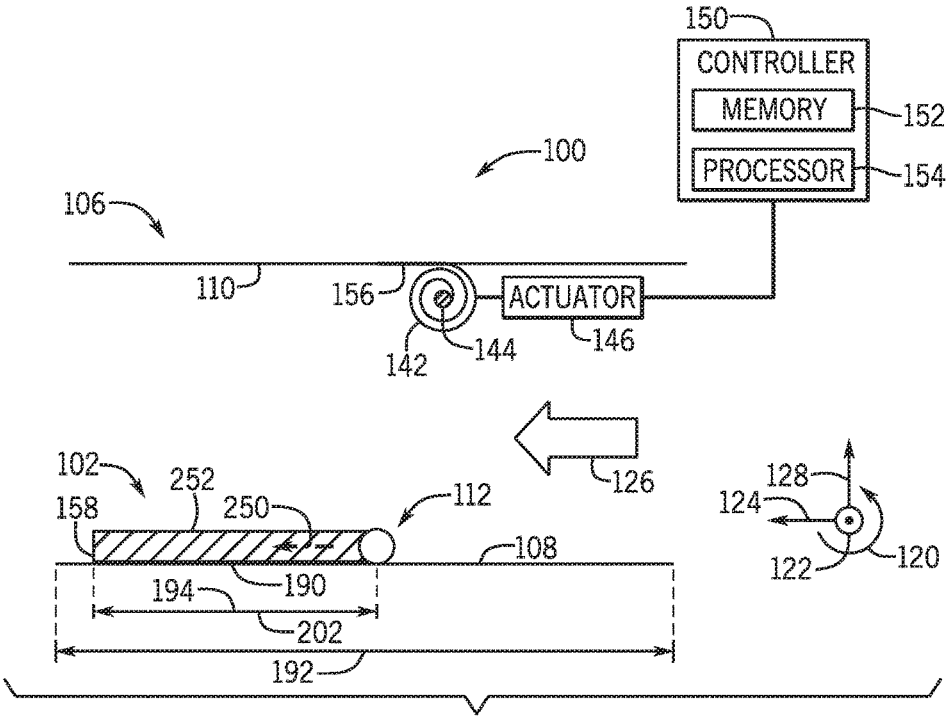
FIG. 7 is a schematic diagram of an embodiment of the evaporator coil of FIG. 5 illustrating a horizontal operating angle, in accordance with the present techniques.

FIG. 7 is a schematic diagram of the evaporator coil 102 having a generally horizontal operating angle 250 relative to the horizontal axis 124. As shown, the left lateral side 190 of the evaporator coil 102 is in contact with the lower wall 108 of the enclosure 106. As such, the length 192 of the enclosure 106 is formed such that there is space for the effective length 194 evaporator coil 102 to extend therein. Indeed, in the horizontal position corresponding to the horizontal operating angle 250, the effective length 194 of the evaporator coil 102 is equal to the actual length 202 of the evaporator coil 102.

The evaporator coil 102 may reach the horizontal operating position by various procedures. To move the evaporator coil 102 to the horizontal operating angle 250, the controller 150 may unspool the rolling sheet member 142 to lower the evaporator coil 102 until the evaporator coil 102 reaches the horizontal operating angle 250. Then, the controller 150 may detach the first end 156 of the rolling sheet member 142 from the top edge 158 of the evaporator coil 102, and then spool the rolling sheet member 142 around the rolling shaft 144 to reduce the unrolled length 184. For example, in some embodiments, the first end 156 of the rolling sheet member 142 may be selectively coupled to the top edge 158 of the evaporator coil by magnetic coupling devices (e.g., electromagnetic locks), retractable hooks, or the like. In this manner, the rolling sheet member 142 and the evaporator coil 102 do not extend vertically within the enclosure 106, thus enabling the air flow 126 to pass therethrough with reduced interference or turbulence. Such a position may be desired when cooling and/or dehumidification of the air flow 126 is not requested. Thus, the air flow 126 experiences a reduced pressure drop in passing through the enclosure 106, such that other components of the HVAC system 100, like a compressor, may be operated in energy saving modes. Enabling the evaporator coil 102 to be pivoted along the pivot shaft 112 to the horizontal position therefore may increase the efficiency of the HVAC system 100 during certain operating modes (e.g., when only the fan is requested, when cooling and/or dehumidification is not requested).

Moreover, to move the evaporator coil 102 from the horizontal operating angle 250 to a tilted operating angle or the vertical operating angle, the controller 150 or a user may reconnect the rolling sheet member 142 to the evaporator coil 102. For example, the controller 150 may extend the rolling sheet member 142 such that it the rolling sheet member is proximate the evaporator coil, then instruct the magnetic coupling devices, retractable hooks, or the like to actuate and hold the rolling sheet member 142 in contact with the evaporator coil 102. Additionally, in some embodiments, a support cord or other suitable structure may be coupled to the top edge 158 of the evaporator coil 102 to enable the controller 150 to lift the evaporator coil 102 from the horizontal operating angle 250. Indeed, such embodiments are discussed below with reference to FIGS. 11-13. Then, the controller 150 may retract the rolling sheet member 142 such that the desired unrolled length 184 corresponding to the target operating angle of the evaporator coil 102 is reached. In certain embodiments, the attachment between the evaporator coil 102 and the rolling sheet member 142 is achieved via hooks, pins, and/or spring clips disposed on one of the evaporator coil 102 or the rolling sheet member 142, and by corresponding recesses or openings disposed in the other one of the evaporator coil 102 or the rolling sheet member 142. Thus, the connection between the evaporator coil 102 and the rolling sheet member 142 may be selectively removable upon instruction by the controller 150 or by user interaction to adapt the HVAC system 100 for different operating modes for the HVAC system 100.

Moreover, in certain embodiments, the evaporator coil 102 may additionally or alternatively pivot such that a right lateral side 252 of the evaporator coil 102 is in contact with the lower wall 108 of the enclosure 106 (e.g., 180 degrees relative to the horizontal axis). In such embodiments, the rolling shaft 144 may be selectively movable along a track, a conveyer belt, or a chamber within the enclosure such that the rolling shaft 144 and the nearby components are able to be moved out of the way of the pivoting evaporator coil 102. By enabling the evaporator coil 102 to move to the horizontal operating angle of 180 degrees relative to the horizontal axis 124 (e.g., on the right side of the enclosure 106), the space within the enclosure may be selectively adapted for specific applications. For example, the evaporator coil 102 may be pivoted along a range of motion of between 0 and 180 degrees from a left side of the enclosure 106 to the right side of the enclosure 106. Alternatively, the range of motion of the evaporator coil 102 may be capped or truncated from either end, such that the evaporator coil 102 may only move from a first position relative to the horizontal axis 124 to a second position relative to the horizontal axis 124. Indeed, the range of motion of the evaporator coil 102 may be configured between any suitable range of degrees relative to the horizontal axis 124, such as from 0 degrees to 180 degrees, from 15 degrees to 180 degrees, from 0 degrees to 175 degrees, from 15 degrees to 175 degrees, from 60 degrees to 180 degrees, from 0 degrees to 150 degrees, from 60 degrees to 150 degrees, from 5 degrees to 90 degrees, from 15 degrees to 90 degrees, from 60 degrees to 90 degrees, or any other suitable range of degrees. The range of motion for the evaporator coil 102 may be continuous, segmented, or a combination thereof, such that a suitable range of motion is provided to the evaporator coil 102.

Figure 8:
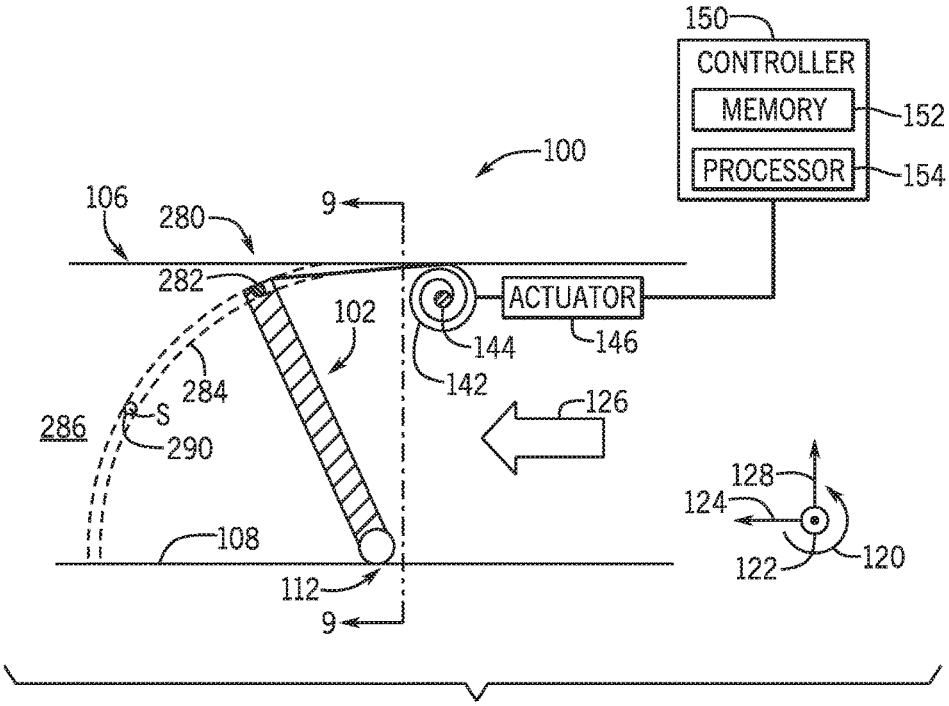
FIG. 8 is a schematic diagram of an embodiment of a pivotable evaporator coil of the HVAC system with a track system, in accordance with the present techniques.

FIG. 8 is a schematic diagram of the evaporator coil 102 having a track system 280. The track system 280 may include track pins 282 disposed in tracks 284. The tracks 284 may be recesses or openings in lateral walls 286 of the enclosure 106 to receive the track pins 282. As shown, the tracks 284 may extend generally semi-circularly within the lateral walls 286. Thus, by controlling the rolling sheet member 142, the controller 150 may raise and lower the evaporator coil 102 such that the track pins 282 move within the tracks 284. More particularly, the track pins 282 may support the evaporator coil 102 as the evaporator coil 102 pivots along the circumferential axis 120. The track pins 282 may receive at least a portion of a weight of the evaporator coil 102, thus reducing at least a portion of the weight of the evaporator coil 102 that would otherwise be distributed on the rolling sheet member 142, the rolling shaft 144, and/or the pivot shaft 112. By more evenly distributing and supporting the weight of the evaporator coil 102, the track system 280 may therefore reduce mechanical fatigue and extend a usable life of the HVAC system 100 and the evaporator coil 102 therein compared to HVAC systems without the track system 280.

Moreover, the track system 280 may increase a reliability that the evaporator coil 102 will pivot between desired operating angles. For example, the tracks 284 may be sized such that lateral and/or vertical deviations of the pivoting evaporator coil 102 are reduced. Additionally, the tracks 284 may be designed to extend along a desired range of motion. That is, the tracks 284 may extend along a certain quantity of degrees relative to the horizontal axis 124 that correspond to the desired range of motion, such as from 0 degrees to 90 degrees as shown. However, the tracks 284 may alternatively be designed to extend from 5 degrees to 90 degrees, from 0 degrees to 180 degrees, 30 degrees to 120 degrees, or any other suitable range of degrees relative to the horizontal axis 124 previously specified with reference to FIG. 7.

In some embodiments, a track sensor 290 may be disposed on the track pins 282 and/or within the tracks 284. The track sensor 290 may transmit signals to the controller 150 that are indicative of the operating angle of the evaporator coil 102. In some embodiments, the track sensor 290 corresponds to the sensor 198 discussed above. Moreover, multiple track sensors 290 may be disposed at regular or semi-regular intervals in the tracks 284, such that the track sensors 290 transmit signals indicative of when the track pins 282 pass over each track sensor 290 of the track sensors 290.

Moreover, to selectively extend or retract the track pins 282, the evaporator coil 102 may include one or more actuators therein. In such embodiments, the tracks 284 may be segmented and the track pins 282 may be retracted until the evaporator coil 102 is moved to a different portion or segment of the tracks 284. Additionally, in embodiments in which the tracks 284 do not extend to the lower wall 108 of the enclosure, the track pins 282 may be retracted to enable the evaporator coil 102 to pivot to the horizontal operating angle. Thus, the evaporator coil 102 may be able to pivot between a certain range of operating angles (e.g., 30 degrees to 90 degrees), while additionally being able to reach the horizontal position when cooling and/or dehumidification of the air flow 126 is not requested.

Figure 9:
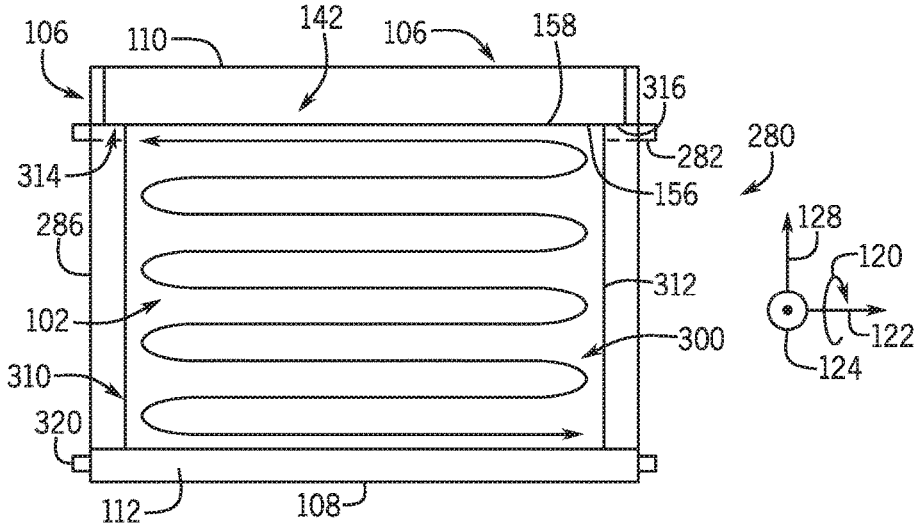
FIG. 9 is a front view of an embodiment of the pivotable evaporator coil shown in FIG. 8, taken along line 9-9, in accordance with the present techniques.

FIG. 9 is a front view of an embodiment of the evaporator coil 102 of FIG. 8 taken along line 9-9. As shown, the evaporator coil 102 includes coils 300 extending therethrough. The coils 300 receive fluid from an inlet, circulate the fluid through a serpentine flow path within the evaporator coil 102, and then send the fluid via an outlet to other HVAC components of the HVAC system 100. By passing the air flow over the coils 300 through the evaporator coil 102, the air flow 126 becomes cooled and/or dehumidified to facilitate conditioning of the interior space. Thus, to provide more efficient cooling and/or dehumidification of the air, the present disclosure directs the air flow 126 through the evaporator coil 102 to reduce bypass of the air around the evaporator coil 102 that would otherwise decrease the evaporator coil 102 efficiency.

For example, as shown, the first end 156 of the rolling sheet member 142 is coupled to the upper edge 158 of the evaporator coil 102. The coupling therebetween may be maintained by pins, hooks, spring clips, or other suitable fasteners. To provide rigidity and/or strength to the rolling sheet member 142, the rolling sheet member 142 may include one or more structurally enhanced sheets. For example, the rolling sheet member 142 may be formed from longitudinally extending cables (e.g., metal cables, wires, chains) having one or more resilient sheets (e.g., rubber, plastic) formed around the cables. The rolling sheet member 142 may have a low or negligible permeability to air, such that the air flow within the enclosure 106 does not pass through the rolling sheet member 142.

Additionally, one or more lateral seal members 310 may be coupled to the evaporator coil 102 to block the air flow from bypassing the evaporator coil 102 around lateral sides of the evaporator coil 102. In some embodiments, the lateral seal members 310 are coupled to the lateral edges 312 of the evaporator coil 102. The lateral seal members 310 may be formed from foam, rubber, or another suitable resilient material for blocking air flow 126 from passing around the evaporator coil 102. In some embodiments, the lateral seal members 310 include rectangular edges 314 that abut with a bottom surface 316 of the rolling sheet member 142. However, in other embodiments, the lateral seal members 310 may have other suitable profiles, such as semicircular profiles, semielliptical profiles, or other suitable profiles with corresponding edges. The lateral seal members 310 may occupy all or a majority of a space between the lateral edges 312 of the evaporator coil 102 and the lateral walls 286 of the enclosure 106. As such, the lateral seal members 310 are designed to pivot with the evaporator coil 102 relative to the enclosure 106, thus sealing or partially sealing gaps between the evaporator coil 102 and the enclosure 106.

Additionally, as shown, the track pins 282 extend from the lateral edge 312 of the evaporator coil 102 to extend through the lateral seal members 310 and the enclosure 106. In some embodiments, corresponding openings are cut or molded into the lateral seal members 310 to permit the track pins 282 to extend therethrough. Additionally, the tracks 284 (FIG. 8) may receive the track pins 282 to support pivoting of the evaporator coil 102. In such embodiments, the tracks 284 (FIG. 8) are recesses or openings in the lateral walls 286 of the enclosure 106 to receive the track pins 282 therein.

Further, the pivot shaft 112 is disposed near the lower wall 108 of the enclosure 106. To enable the pivot shaft 112 to rotate relative to the enclosure, pivot shaft pins 320 may extend through corresponding openings or recesses in the lateral walls 286 of the enclosure 106. The evaporator coil 102 is mounted to the pivot shaft 112, such that movement of the evaporator coil 102 is enabled by the pivot shaft 112 rotating via the pivot shaft pins 320. Moreover, in some embodiments, the pivot shaft 112 may be independently actuated or motorized (e.g., by an actuator, a motor, a servo motor, etc.) to cause the evaporator coil 102 to pivot with or without actuation of the actuator 146 (FIG. 8). Moreover, the track pins 282 and/or the pivot shaft pins 320 may be retractable, spring-loaded, or otherwise able to be selectively extended and retracted from the evaporator coil 102 and the pivot shaft 112 respectively to enable assembly and operation of the HVAC system 100.

Figure 10:
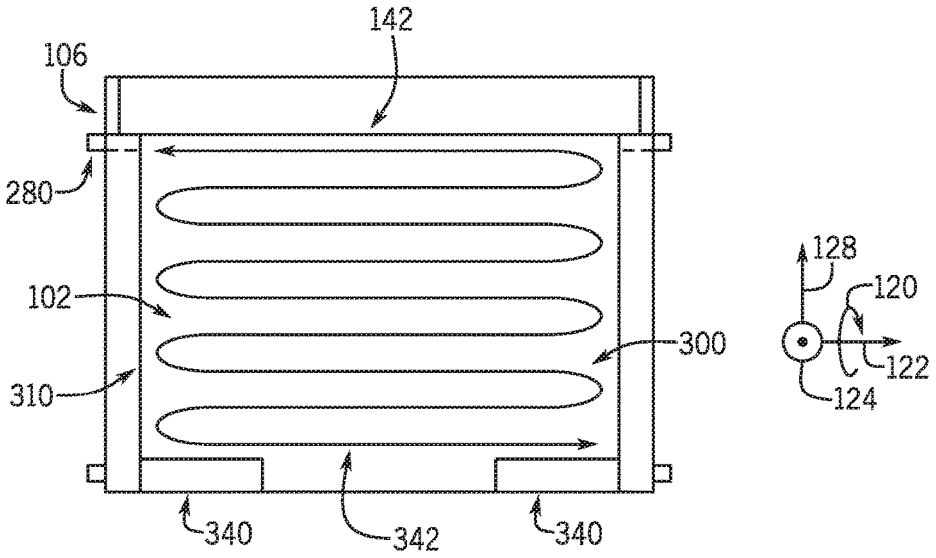
FIG. 10 is a front view of an embodiment of the pivotable evaporator coil shown in FIG. 9 illustrating hinges of the pivotable evaporator coil, in accordance with the present techniques.

FIG. 10 is a front view of an embodiment of the evaporator coil 102 of FIG. 9 having one or more hinges 340. The HVAC system 100 includes the evaporator coil 102 having the coils 300, the rolling sheet member 142, the lateral seal members 310, and the track system 280, as discussed above with reference to FIG. 9. As shown, two hinges 340 are attached at a bottom portion 342 of the evaporator coil 102. Another portion of the hinges 340 may be attached to a suitable surface of the enclosure 106, such as the lower wall 108. Additionally, another suitable quantity of hinges, such as 1, 2, 3, 4, 5, 6, or more hinges each having suitable lengths and widths may be attached at another suitable location on the evaporator coil 102.

The hinges 340 may provide an axis of rotation to the evaporator coil 102 to enable the evaporator coil 102 to pivot along the circumferential axis 120. As such, the hinges 340 operate similarly to the pivot shaft to enable the evaporator coil 102 to rotate between various operating angles relative to the horizontal axis 124. Additionally, in some embodiments, the hinges 340 may be employed to mount the evaporator coil 102 to the upper wall 110 of the enclosure, such that the evaporator coil 102 and the techniques discussed herein may be employed upside down (e.g., rotated around the horizontal axis 124 by 180 degrees, reflected across the horizontal axis 124). In certain embodiments, the pivot shaft discussed above may also be used to mount the evaporator coil 102 to the top of the enclosure to enable the disclosed techniques to be applied upside down. As such, by selectively using the hinges 340 or the pivot shaft, the position of the evaporator coil 102, the operating angle of the evaporator coil 102, and the circumferential axis 120 around which the evaporator coil 102 pivots may be adapted to fit various enclosures and operating conditions.

Figure 11:
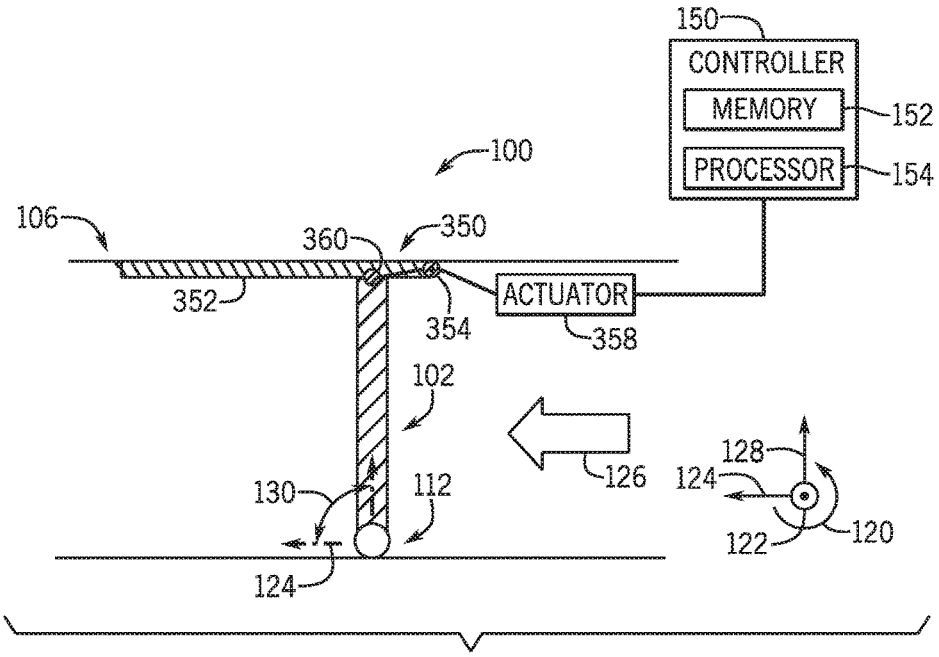
FIG. 11 is a schematic diagram of an embodiment of the pivotable evaporator coil of the HVAC system, in accordance with the present techniques.

As previously discussed, multiple embodiments may be employed to enable the evaporator coil 102 to pivot to various operating angles during operation of the HVAC system. For example, FIG. 11 is a schematic diagram illustrating an embodiment of evaporator coil 102 illustrating a sealing assembly 350. The sealing assembly 350 cooperates with the evaporator coil 102 disposed within the enclosure 106 to direct the air flow 126 through the evaporator coil 102. The evaporator coil 102 may be coupled to the pivot shaft 112 as shown, the hinges as discussed above with reference to FIG. 10 above, or to another suitable component to enable the evaporator coil 102 to pivot along the circumferential axis 120 to various operating angles, such as the vertical operating angle 130 shown herein.

The sealing assembly 350 includes a rigid sheet member 352 that is rigidly coupled to a rolling shaft 354, which may rotate around the circumferential axis 120. The rolling shaft 354 may extend between all, a majority, or a portion of a width of the enclosure 106 (e.g., into the page) and serve as a rotation point for the rigid sheet member 352. The rigid sheet member 352 may be a strong, rigid, and/or stiff rectangular component that can be supported via the rolling shaft 354 without folding or buckling under a weight of the rigid sheet member 352. For example, the rigid sheet member 352 may be one or more sheets of metal (e.g., aluminum, stainless steel, etc.) one or more sheets of molded plastic, one or more sheets of another suitable material, or any combination thereof. In some embodiments, the rolling shaft 354 is coupled to an actuator 358. Upon instruction by the controller 150, the actuator 358 may cause the rolling shaft 354 to rotate. For example, the actuator 358 may be a linear actuator that is physically coupled to the rolling shaft 354. Alternatively, the actuator 358 may include a linear actuator that releases or contracts a line (e.g., rope, cord, chain, etc.) that extends between the actuator 358 and the rigid sheet member 352, such that suitable rotation of the rigid sheet member 352 is caused based on the motion of the line. Thus, because the rigid sheet member 352 is rigidly coupled to the rolling shaft 354, the rigid sheet member 352 may rotate to raise or lower within the enclosure 106.

In some embodiments, the rigid sheet member 352 includes a base track (e.g., a channel) extending from lateral edges of the rigid sheet member 352 in a plane defined by the horizontal axis 124 and the vertical axis 128. The base track may receive one or more receiving pins 360 of the evaporator coil 102 to enable the evaporator coil 102 to pivot around the pivot shaft 112 based on motion of the rigid sheet member 352. The base track will be discussed in greater detail with reference to FIG. 14 below. Additionally, further description of the evaporator coil 102 rotating relative to the rigid sheet member 352 will be discussed with reference to FIG. 12 below.

Figure 12:
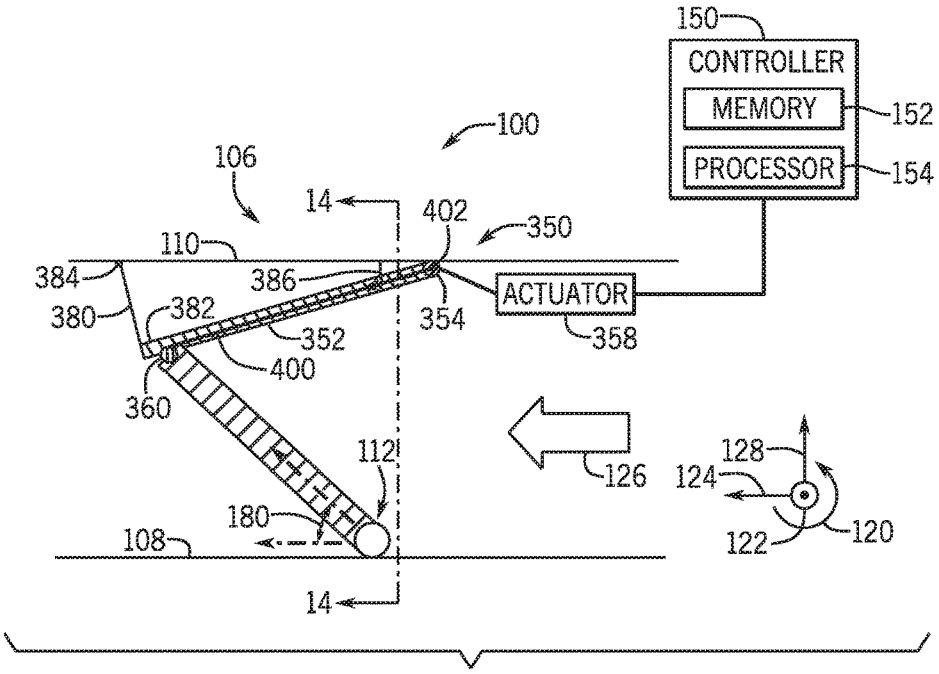
FIG. 12 is a schematic diagram of an embodiment of the pivotable evaporator coil of FIG. 11 illustrating a tilted operating angle, in accordance with the present techniques.

FIG. 12 is an embodiment of the evaporator coil 102 having the sealing assembly 350 of FIG. 11. As shown, the evaporator coil 102 is at the tilted operating angle 180 relative to the horizontal axis 124. The receiving pins 360 couple the evaporator coil 102 to the rigid sheet member 352 via the base track of the rigid sheet member 352. To move the evaporator coil 102 to the tilted operating angle 180 from the vertical operating angle (FIG. 11), the controller 150 may instruct the actuator 358 to rotate the rolling shaft 354 along the circumferential axis 120. Thus, because the rigid sheet member 352 is rigidly coupled to the rolling shaft 354, the rigid sheet member 352 pivots along the circumferential axis 120. Additionally, because the evaporator coil 102 is slidably mounted in the base track of the rigid sheet member 352, the evaporator coil 102 pivots along the pivot shaft 112 along the circumferential axis 120. Thus, the evaporator coil 102 may have an operating angle that is between zero degrees and 90 degrees or between 90 and 180 degrees relative to the horizontal axis 124 based on the position of the rigid sheet member 352.

Further, to support the rigid sheet member 352, the sealing assembly 350 may include a sheet support cord 380 that extends between a left lateral end 382 of the rigid sheet member 352 and a cord mount 384 on the upper wall 110 of the enclosure 106. The sheet support cord 380 may be coupled to left lateral end 382 of the rigid sheet member 352 by any suitable manner, such as coupling the sheet support cord 380 through an opening or around a suitable peg of the rigid sheet member 352. The sheet support cord 380 may be any suitable cord or cord-like element, such as a cable, a rope, or a chain. In some embodiments, the cord mount 384 may be a motorized spool having a rolled portion of the sheet support cord 380 held therein. Alternatively, the cord mount 384 may include one or more pulleys that the sheet support cord 380 is drawn around. In embodiments having the one or more pulleys as the cord mount 384, the sheet support cord 380 may further extend to the actuator 358 or to another suitable actuator, such that the controller 150 may instruct the actuator 358 to lengthen or contract the sheet support cord 380. In some embodiments, the sheet support cord 380 may receive a portion of the weight of the rigid sheet member 352. The sheet support cord 380 may be actuated in addition or in alternative to actuation of the rolling shaft 354 to control an angle 386 of the rigid sheet member 352 relative to the upper wall 110 of the enclosure 106. Moreover, as will be described in more detail with reference to the evaporator coil 102 in the horizontal operating angle in FIG. 13 below, an evaporator coil support cord 400 and a corresponding evaporator coil support cord mount 402 may also be included in the HVAC system 100 to support the evaporator coil 102.

Moreover, similar to discussion related to the sealing assembly 140 of FIGS. 5-10, the controller 150 may determine the operating angle based on a stored log of actions of the actuator, based on sensor feedback, and/or based on trigonometric calculations. Additionally, the controller 150 may instruct the actuator 358 to move the evaporator coil 102 to a target operating angle based on determinations related to various operating parameters of the HVAC system 100, such as current temperatures, current pressures, current flow rates, current humidity, current outdoor temperature, target temperatures, target pressures, target flow rates, target humidity, or other parameters of the HVAC system 100. The controller 150 may instruct the actuator 358 to change the operating angle of the evaporator coil 102 until the controller 150 determines that the evaporator coil 102 is in an operating angle that is within the threshold of the target operating angle. In this manner, the controller 150 may change the operating angle of the evaporator coil 102 as an additional degree of freedom for the HVAC system 100, while also increasing the evaporator capacity of the HVAC system 100.

Figure 13:
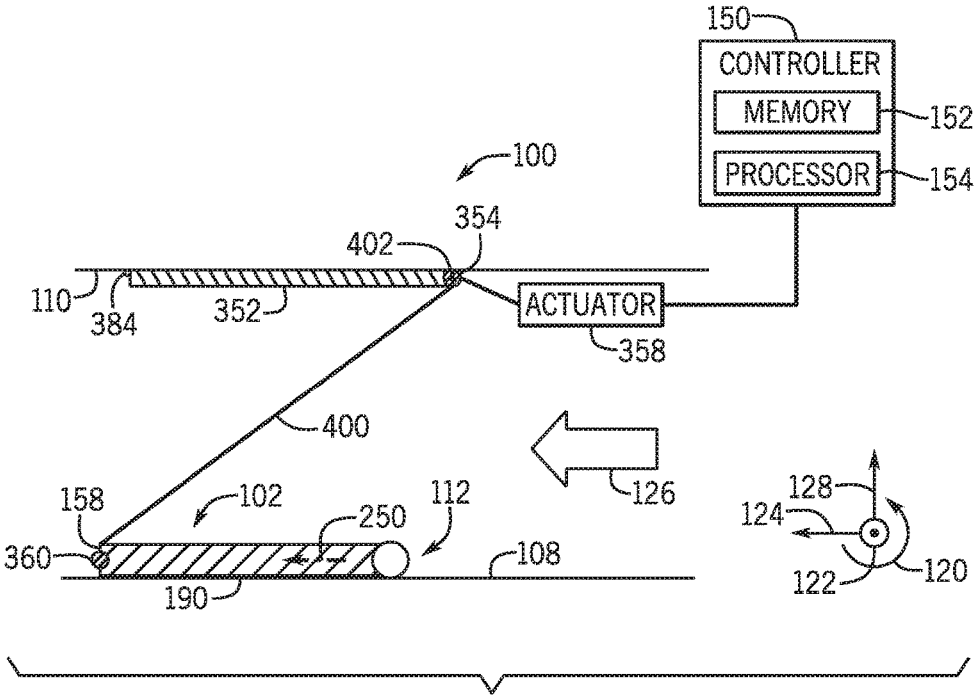
FIG. 13 is a schematic diagram of an embodiment of the pivotable evaporator coil of FIG. 11 illustrating a horizontal operating angle, in accordance with the present techniques.

FIG. 13 is a schematic diagram of the evaporator coil 102 having a horizontal operating angle 250 relative to the horizontal axis 124 (e.g., 0 degrees from the horizontal axis 124). As shown and as previously discussed with reference to FIG. 7, the left lateral side 190 of the evaporator coil 102 is in contact with the lower wall 108 of the enclosure 106. To move the evaporator coil 102 from the tilted operating angle to the horizontal operating angle 250, the controller 150 may instruct the rigid sheet member 352 to move to have an increased angle 386 (FIG. 12) relative to the upper wall 110 of the enclosure 106 to lower the evaporator coil 102 to approach the lower wall 108. Then, the controller 150 may have instructed the receiving pins 360 to retract from the base track of the rigid sheet member 352, thus uncoupling the evaporator coil 102 from the rigid sheet member 352. Then, the evaporator coil support cord 400, which may be coupled to the evaporator coil support cord mount 402 as shown, may be used to lower the evaporator coil 102 such that the left lateral side 190 is in contact with the lower wall 108. In some embodiments, the receiving pins 360 may be retracted from the base track from any operating angle of the evaporator coil, and the evaporator coil support cord 400 may be used to lower the evaporator coil 102. In this manner, the rigid sheet member 352 and the evaporator coil 102 do not extend vertically within the enclosure 106, thus enabling the air flow 126 to pass therethrough without reduced interference or turbulence. Thus, the air flow 126 experiences a reduced pressure drop in passing through the enclosure 106, such that other components of the HVAC system 100, like the compressor, may be operated in energy saving modes. Such a position may be desired when cooling and/or dehumidification of the air flow 126 is not requested. Enabling the evaporator coil 102 to be pivoted along the pivot shaft 112 to the horizontal position therefore may increase the efficiency of the HVAC system 100 during certain operating modes (e.g., when only the fan is requested, when cooling and/or dehumidification are not requested).

Moreover, the evaporator coil support cord 400 may be utilized to evaporator coil 102 may be utilized to move the evaporator coil 102 from the horizontal operating angle to a tilted operating angle. In such embodiments, the controller 150 may instruct the evaporator coil support cord mount 402 to pull on the evaporator coil support cord 400 and raise the evaporator coil 102. Additionally, the controller 150 may instruct the rolling shaft 354 to move the rigid sheet member 352 closer to the evaporator coil 102. Then, after the evaporator coil 102 contacts the rigid sheet member 352, the controller 150 may instruct the receiving pins 360 to extend within the base track of the rigid sheet member 352 to couple the evaporator coil 102 thereto. Thus, the present disclosure enables the evaporator coil 102 to be selectively lowered and raised to various operating angles, including horizontal operating angles, to increase the evaporator capacity of the evaporator coil 102 compared to evaporator coils without changeable operating angles. Indeed, by using the support cords 380, 400, the HVAC system 100 may enable the evaporator coil 102 to reach and return from the horizontal operating angle 250 automatically (e.g., upon controller instruction).

Moreover, to move the evaporator coil 102 from the horizontal operating angle 250 to a tilted operating angle or the vertical operating angle, the controller 150 or a user may reconnect the rigid sheet member 352 to the evaporator coil 102. Then, the controller 150 may instruct the rigid sheet member 352 to move such that the evaporator coil 102 slides within the base track to the target operating angle. Thus, the connection may be selectively removable upon instruction by the controller 150 or by user interaction to adapt the HVAC system 100 for different operating modes for the HVAC system 100.

Figure 14:
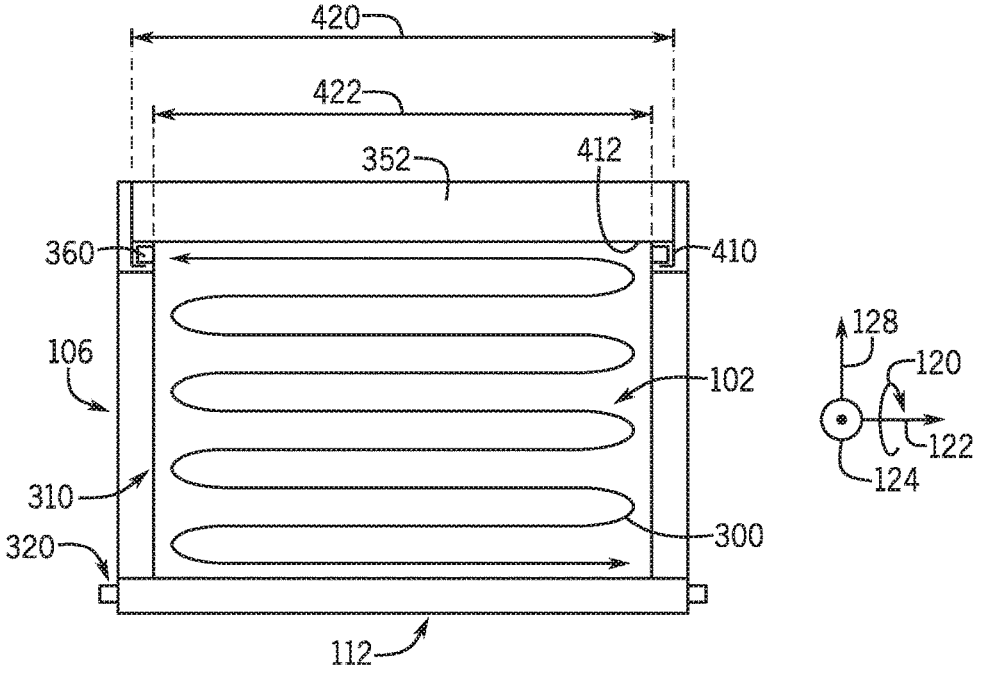
FIG. 14 is a front view of an embodiment of the pivotable evaporator coil, taken along line 14-14, in accordance with the present techniques.

FIG. 14 is a front perspective view of an embodiment of the evaporator coil 102 of FIG. 12 taken along line 14-14. As shown, the evaporator coil 102 is disposed within the enclosure 106 and includes the coils 300 extending therethrough, the lateral seal members 310, and the pivot shaft 112 having the pivot shaft pins 320.

Additionally, as shown, the rigid sheet member 352 includes the base track 410 extending along a bottom surface 412 of the rigid sheet member 352. In some embodiments, the base track 410 includes two L-shaped cross sections, one coupled to each lateral side the rigid sheet member 352. Moreover, the rigid sheet member 352 may have a width 420 that is larger than a width 422 of the evaporator coil 102. Thus, the receiving pins 360 may extend from the lateral edges 312 of the evaporator coil 102 to be received by the base track 410, slidably coupling the evaporator coil 102 to the rigid sheet member 352. In this manner, the evaporator coil 102 may pivot via the pivot shaft 112, such that the receiving pins 360 move correspondingly within the base track 410. To block the receiving pins 360 from falling out of longitudinal ends of the base track 410 (e.g., terminals of the base track 410 separated along the horizontal axis 124), the base track 410 may include end caps or another suitable stopper element to retain the receiving pins 360 within the base track 410.

Accordingly, the present disclosure is directed to a pivotable evaporator coil for use within an HVAC system to enable the evaporator coil to move between various operating angles. Thus, the operating angle of the evaporator coil may be automatically adjusted by the controller within an enclosure to leverage the angle of the evaporator coil to increase the evaporator capacity, thus providing an additional degree of freedom to allow the HVAC system to operate more efficiently. The operating angle of the evaporator coil may be pivotally mounted on a pivot shaft or hinges, such that movement of an actuator causes the evaporator coil to pivot within a threshold range of a target operating angle. The pivotable evaporator coil may be employed to increases a maximum evaporator capacity for the evaporator coil, as compared to stationary evaporator coils. Accordingly, pivotable evaporator coils, as described herein, may be employed to increase efficiency and reduce costs of the HVAC system, while conditioning interior spaces to desired specifications.

While only certain features and embodiments of the present disclosure have been illustrated and described, many modifications and changes may occur to those skilled in the art (e.g., variations in sizes, dimensions, structures, shapes and proportions of the various elements, values of parameters (e.g., temperatures, pressures, etc.), mounting arrangements, use of materials, colors, orientations, etc.) without materially departing from the novel teachings and advantages of the subject matter recited in the claims. The order or sequence of any process or method steps may be varied or re-sequenced according to alternative embodiments. It is, therefore, to be understood that the appended claims are intended to cover all such modifications and changes as fall within the true spirit of the present disclosure. Furthermore, in an effort to provide a concise description of the exemplary embodiments, all features of an actual implementation may not have been described (i.e., those unrelated to the presently contemplated best mode of carrying out the present disclosure, or those unrelated to enabling the claimed disclosure). It should be appreciated that in the development of any such actual implementation, as in any engineering or design project, numerous implementation specific decisions may be made. Such a development effort might be complex and time consuming, but would nevertheless be a routine undertaking of design, fabrication, and manufacture for those of ordinary skill having the benefit of this disclosure, without undue experimentation.

The invention claimed is:

1. A heating, ventilating, and air conditioning (HVAC) system, comprising:

an enclosure;

an evaporator coil disposed within the enclosure;

a pivot member coupled between an edge portion of the evaporator coil and the enclosure, wherein the pivot member is configured to enable the evaporator coil to pivot relative to the enclosure to adjust an operating angle of the evaporator coil during operation of the HVAC system; and an actuator configured to enable pivoting of the evaporator coil to a target operating angle based on an operating parameter input.

2. The HVAC system of claim 1, wherein the edge portion of the evaporator coil comprises a first edge portion, wherein the HVAC system comprises a sealing assembly disposed between an inner wall of the enclosure and a second edge portion of the evaporator coil, wherein the second edge portion of the evaporator coil is opposite from first the edge portion, and wherein the sealing assembly is configured to block an air flow from bypassing the evaporator coil.

3. The HVAC system of claim 2, wherein the sealing assembly comprises a rolling shaft extending along a width of the enclosure, the rolling shaft is rotatable relative to the enclosure, and wherein the sealing assembly comprises a rolled sheet member configured to selectively roll and unroll from the rolling shaft to adjust the operating angle of the evaporator coil.

4. The HVAC system of claim 2, wherein the sealing assembly comprises a rolling shaft extending along a width of the enclosure, the rolling shaft is rotatable relative to the enclosure, and the sealing assembly comprises a rigid sheet member having a first end coupled to the rolling shaft and a second end coupled to the second edge portion of the evaporator coil, wherein the rigid sheet member is configured to pivot to adjust the operating angle of the evaporator coil.

5. The HVAC system of claim 4, wherein the rigid sheet member comprises base tracks extending along a bottom surface of the rigid sheet member, wherein the second edge portion of the evaporator coil comprises receiving pins extending therefrom, and wherein the base tracks are configured to slidably receive the receiving pins to couple the evaporator coil to the sealing assembly.

6. The HVAC system of claim 1, wherein the pivot member comprises a pivot shaft extending along a width of the enclosure, a first pivot shaft pin coupled to a first longitudinal end of the pivot shaft, and a second pivot shaft pin coupled to a second longitudinal end of the pivot shaft, wherein the first pivot shaft pin and the second pivot shaft pins each extend within corresponding recesses disposed in lateral walls of the enclosure.

7. The HVAC system of claim 1, wherein the operating angle of evaporator coil is adjustable during operating between 0 degrees and 90 degrees relative to a longitudinal axis extending through the enclosure.

8. The HVAC system of claim 1, wherein the target operating angle comprises an angle between 0 and 90 degrees.

9. The HVAC system of claim 1, wherein the operating parameter input is transmitted by a temperature sensor, a pressure sensor, a flow sensor, an electricity meter, a voltage sensor, a contact sensor, a thermostat, a humidistat, and/or a user interface.

10. The HVAC system of claim 1, wherein the enclosure comprises tracks recessed into lateral walls of the enclosure, wherein the edge portion of the evaporator coil comprises a first edge portion of the evaporator coil, wherein the evaporator coil comprises a second edge portion opposite of the first edge portion, and wherein the evaporator coil comprises track pins extending from the second edge portion of the evaporator coil and into the tracks to guide pivoting of the evaporator coil.

11. The HVAC system of claim 1, comprising lateral seal members coupled to lateral edges of the evaporator coil, wherein the lateral seal members are configured to slide along lateral walls of the enclosure to block an air flow from bypassing between the lateral edges of the evaporator coil and the lateral walls of the enclosure.

12. The HVAC system of claim 1, comprising a controller comprising a memory and a processor, wherein the controller is configured to:

determine the target operating angle of the evaporator coil based on the operating parameter input; and regulate operation of the actuator to pivot the evaporator coil to pivot to the target operating angle.

13. The HVAC system of claim 12, comprising a sealing assembly coupled between the evaporator coil and the actuator, wherein the actuator comprises a linear actuator communicatively coupled to the controller, and wherein the controller is configured to instruct the linear actuator to extend or retract to adjust a position of the sealing assembly to enable adjustment of the operating angle of the evaporator coil.

14. A heating, ventilating, and air conditioning (HVAC) system, comprising:

an enclosure;

an evaporator coil disposed within the enclosure;

a pivot member coupled between an edge portion of the evaporator coil and the enclosure, wherein the pivot member is configured to enable the evaporator coil to pivot relative to the enclosure to adjust an operating angle of the evaporator coil during operation of the HVAC system; and a controller comprising a memory and a processor, wherein the controller is configured to:

determine a target operating angle of the evaporator coil; and regulate operation of an actuator to pivot the evaporator coil to have the operating angle within a threshold of the target operating angle.

15. The HVAC system of claim 14, wherein the controller is configured to determine the target operating angle of the evaporator coil based on an operating parameter input.

16. The HVAC system of claim 14, wherein the edge portion of the evaporator coil comprises a first edge portion, and wherein the HVAC system comprises a support cable mount coupled to the enclosure, and a cable coupled between a second edge portion of the evaporator coil and the support cable mount, wherein the actuator is configured to actuate the cable to selectively raise or lower the second edge portion of the evaporator coil to cause the evaporator coil to pivot about the pivot member.

17. The HVAC system of claim 14, wherein the edge portion of the evaporator coil comprises a first edge portion of the evaporator coil, and wherein the HVAC system comprises a sealing assembly coupled to a second edge portion of the sealing assembly, and wherein the sealing assembly is configured to block an air flow from bypassing the evaporator coil.

18. The HVAC system of claim 17, wherein the sealing assembly is selectively coupled to the second portion of the evaporator coil via spring pins, and wherein the controller is configured to instruct an additional actuator to retract the spring pins to selectively decouple the sealing assembly from the evaporator coil, wherein the evaporator coil is configured to be pivoted to a horizontal operating angle to enable the air flow to bypass the evaporator coil when the sealing assembly is decoupled from the evaporator coil.

19. The HVAC system of claim 14, wherein the controller is configured to determine whether cooling, dehumidification, or both for a conditioned space is requested; and in response to determining that the cooling, dehumidification, or both for the conditioned space is not requested, instruct the actuator to pivot the evaporator coil to a horizontal operating angle.

20. The HVAC system of claim 19, wherein the controller is configured to determine whether subsequent cooling, dehumidification, or both for the conditioned space is requested; and in response to determining that the subsequent cooling, dehumidification, or both for the conditioned space is requested, instruct the actuator to pivot the evaporator coil from the horizontal operating angle to a tilted operating angle or a vertical operating angle.

21. A method for operating a heating, ventilating, and air conditioning (HVAC) system, comprising:

receiving an operating parameter input;

determining a target operating angle for an evaporator coil disposed in an enclosure of the HVAC system based on the operating parameter input; and adjusting an operating angle of the evaporator coil to the target operating angle.

22. The method of claim 21, wherein the operating angle of the evaporator coil is adjustable between 0 and 90 degrees relative to a longitudinal axis extending through the enclosure.

23. The method of claim 21, comprising adjusting the operating angle of the evaporator coil during operation of the HVAC system.

24. The method of claim 21, wherein adjusting the operating angle of the evaporator coil comprises instructing an actuator to spool or unspool a cable coupled between the evaporator coil and the actuator, such that movement of the cable causes movement of the evaporator coil around a pivot axis.

25. The method of claim 21, wherein adjusting the operating angle of the evaporator coil comprises instructing an actuator to adjust a sealing assembly coupled to evaporator coil and the actuator, such that movement of the sealing assembly causes movement of the evaporator coil around a pivot axis.

26. The method of claim 21, wherein the target operating angle corresponds to a horizontal operating angle, and wherein the method comprises providing an air flow through the enclosure that bypasses the evaporator coil.

* * * * *